US007134580B2

(12) United States Patent
Garrison et al.

(10) Patent No.: US 7,134,580 B2
(45) Date of Patent: Nov. 14, 2006

(54) SPOUT ASSEMBLY FOR DISPENSING LIQUID FROM A NOZZLE

(75) Inventors: Timothy M. Garrison, Cincinnati, OH (US); Harold M. Schubert, Fairfield, OH (US); Bryan S. York, Liberty Township, OH (US); Daniel E. Preston, Milford, OH (US)

(73) Assignee: Delaware Capital Formation, Inc., Wilmington, DE (US)

( * ) Notice: Subject to any disclaimer, the term of this patent is extended or adjusted under 35 U.S.C. 154(b) by 60 days.

(21) Appl. No.: 10/684,331

(22) Filed: Oct. 10, 2003

(65) Prior Publication Data

US 2005/0077317 A1 Apr. 14, 2005

(51) Int. Cl.
*B65D 5/72* (2006.01)

(52) U.S. Cl. ..... 222/566; 222/108; 222/571; 141/59; 141/392

(58) Field of Classification Search ..... 222/566, 222/588, 108, 571; 141/59, 392, 206–216
See application file for complete search history.

(56) References Cited

U.S. PATENT DOCUMENTS 2,004,203 A * 6/1935 Howell ..... 251/155
2,303,179 A 11/1942 Sitton et al.
2,686,626 A 8/1954 Slattery
2,818,889 A 1/1958 Krause
2,867,249 A 1/1959 Denlinger
2,874,735 A 2/1959 Boone
3,012,592 A 12/1961 Wright et al.
3,088,500 A 5/1963 Payne
3,276,486 A * 10/1966 Slattery ..... 251/43
3,502,121 A 3/1970 Moore et al.
3,586,069 A 6/1971 Vest et al.
3,593,762 A 7/1971 Johnson et al.
3,603,359 A 9/1971 Belue
3,710,831 A 1/1973 Riegel
3,881,528 A 5/1975 Mackenzie
3,982,571 A 9/1976 Fenton et al.
3,994,323 A 11/1976 Takahata et al.
4,005,339 A * 1/1977 Plantard ..... 361/215
4,011,897 A 3/1977 Hansel
4,023,601 A 5/1977 Hansel
4,090,539 A 5/1978 Krupp
4,098,307 A 7/1978 Taylor
4,121,635 A 10/1978 Hansel
4,143,689 A 3/1979 Conley et al.
4,153,085 A 5/1979 Adams
4,213,488 A 7/1980 Pyle
4,214,614 A 7/1980 Pyle
4,245,681 A 1/1981 Guertin
4,453,578 A 6/1984 Wilder
4,497,350 A 2/1985 Guertin
4,697,624 A 10/1987 Bower et al.
4,809,753 A 3/1989 Fink, Jr.
4,825,914 A 5/1989 Leininger
4,934,565 A 6/1990 Heisey et al.
4,984,612 A 1/1991 de la Haye (Continued)

OTHER PUBLICATIONS

International Searching Authority, *International Search Report for PCT Application No. PCT/US04/33617*, Patent Cooperation Treaty Form PCT/ISA/210, Feb. 28, 2005.

(Continued)

*Primary Examiner*—Frederick C. Nicolas
(74) *Attorney, Agent, or Firm*—Dinsmore & Shohl LLP

(57) ABSTRACT

Spout assemblies are provided for dispensing liquid from a nozzle.

29 Claims, 24 Drawing Sheets

U.S. PATENT DOCUMENTS 5,069,260 A 12/1991 Shea
5,085,258 A 2/1992 Fink, Jr. et al.
5,121,777 A 6/1992 Leininger et al.
5,127,451 A 7/1992 Fink, Jr. et al.
5,341,855 A 8/1994 Rabinovich
5,421,382 A 6/1995 Leininger et al.
5,435,356 A 7/1995 Rabinovich
5,474,115 A 12/1995 Fink, Jr.
5,522,440 A * 6/1996 Mitchell ..... 141/59
5,549,132 A * 8/1996 Butterfield et al. ..... 137/270
5,603,364 A 2/1997 Kerssies
5,645,116 A 7/1997 McDonald
5,655,576 A 8/1997 Leininger et al.
5,775,384 A 7/1998 Alvern
5,967,385 A 10/1999 Coates, III
6,024,140 A * 2/2000 Garrison et al. ..... 141/59
6,311,742 B1 11/2001 Nusen et al.
6,585,014 B1 7/2003 Fink, Jr.

OTHER PUBLICATIONS

International Searching Authority, *Written Opinion of the International Searching Authority for PCT Application No. PCT/US04/33617*, Patent Cooperation Treaty Form PCT/ISA/237, Feb. 28, 2005.

* cited by examiner

SPOUT ASSEMBLY FOR DISPENSING LIQUID FROM A NOZZLE

TECHNICAL FIELD

The present invention relates to spout assemblies and more particularly to spout assemblies for dispensing liquid from a nozzle.

BACKGROUND OF THE INVENTION

A conventional fluid nozzle includes a spout assembly for dispensing liquid from a nozzle. The spout is attached to the outlet of the nozzle body and the spout assembly includes a discharge end for dispensing fluid. In certain applications, such as with delivery of fuel, spout assemblies may have a design that results in undesirable leakage or drippage of fuel that may violate environmental or other regulations. Consequently, there is a need for spout assemblies for use with a dispensing nozzle that reduces or eliminates leakage or drippage to the surrounding environment.

SUMMARY OF THE INVENTION

Accordingly, it is an aspect of the present invention to obviate problems and shortcomings of conventional spout assemblies. More particularly, it is an aspect of the present invention to provide spout assemblies for dispensing liquid from a nozzle.

To achieve the foregoing and other aspects, and in accordance with the purposes of the present invention defined herein, a spout assembly is provided for dispensing liquid from a nozzle. The spout assembly includes a structural conduit including a first end portion for attaching relative to a nozzle body and a second end portion for dispensing liquid. The structural conduit further includes an interior passage providing an internal flow path from the first end portion to the second end portion and at least one internal sidewall. The internal sidewall includes a first sidewall portion with a first cross-sectional dimension, a second sidewall portion with a second cross-sectional dimension that is smaller than the first cross-sectional dimension, and a transition location between the first and second sidewall portions. The transition location provides for the change in cross-sectional dimensions between the first sidewall portion and the second sidewall portion. The first sidewall portion includes a length at least partially defining a substantially straight liquid flow path, wherein the substantially straight liquid flow path extends through the transition location without the transition location changing the substantially straight liquid flow path.

In accordance with further aspects of the present invention, a spout assembly is provided for dispensing liquid from a nozzle. The spout assembly includes a structural conduit with a first end portion for attaching relative to a nozzle body and a second end portion for dispensing liquid. The structural conduit further includes an interior passage providing an internal flow path from the first end portion to the second end portion and at least one internal sidewall. The internal sidewall includes a first sidewall portion with a first cross-sectional dimension, a second sidewall portion with a second cross-sectional dimension that is smaller than the first cross-sectional dimension, and a transition location between the first and second sidewall portions, wherein the transition location provides for the change in cross-sectional dimensions between the first sidewall portion and the second sidewall portion, wherein the internal sidewall is adapted to substantially prevent pooling of liquid being dispensed from the nozzle.

In accordance with additional aspects of the present invention, a spout assembly is provided for dispensing liquid from a nozzle and movable between a storage orientation and a dispensing orientation. The nozzle assembly includes a structural conduit with a first end portion for attaching relative to a nozzle body and a second end portion for dispensing liquid. The structural conduit further includes an interior passage providing an internal liquid flow path in a general direction from the first end portion to the second end portion and at least one internal sidewall defining the internal flow path running from the first end portion to the second end portion. Each of the first end and the second end portion have generally cylindrical configurations with a diameter of the internal flow path in the second end being reduced relative to the diameter of the internal flow path in the first end. A transition portion is positioned intermediate the first end and the second end for reducing the cross-sectional area of the internal flow path therebetween. The internal liquid flow path in the transition portion being asymmetrically tapered to alter the cross-sectional area of the internal liquid flow path from a first inside diameter of the liquid flow path adjacent an inlet end of the transition portion to a second inside diameter of the liquid flow path adjacent an outlet end of the transition portion. A lower inside surface of the liquid flow path in the transition portion being flattened relative to an opposed upper inside surface of the transition portion so that, when the spout is in a dispensing orientation, the lowest point in any cross-sectional portion of the flow path through the transition portion is not at a substantially higher elevation than a line connecting the lowest points of the flow path at the respective upstream portions of the first end and the transition portion.

In accordance with still further aspects of the present invention, a spout assembly is provided for dispensing liquid from a nozzle. The spout assembly includes a structural conduit with a first end portion for attaching relative to a nozzle body, a second end portion for dispensing liquid, and an interior passage adapted to provide an internal flow path from the first end portion to the second end portion. A spout adapter is mounted with respect to the first end portion, the spout adapter includes a pressure activated control valve adapted to permit flow of liquid into the spout assembly from a nozzle at a predetermined liquid pressure. The spout adapter further comprises a venturi channel and an attitude device in fluid communication with the venturi channel. The attitude device comprises a closing body adapted to close an opening of the venturi channel upon tilting of the spout assembly beyond a predetermined angle.

In accordance with yet additional aspects of the present invention, a spout assembly is provided for dispensing liquid from a nozzle. The spout assembly includes a structural conduit with a first end portion for attaching relative to a nozzle body, a second end portion for dispensing liquid, a sensing opening located at the second end, and an interior passage adapted to provide an internal flow path from the first end portion to the second end portion. A spout adapter is mounted with respect to the first end portion and includes a pressure activated control valve adapted to permit flow of liquid into the spout assembly from a nozzle at a predetermined liquid pressure, and a venturi channel. A flexible conduit provides fluid communication between the sensing opening and the venturi channel. A fluid tube is disposed in the interior passage of the structural conduit and in fluid communication with the pressure activated control valve and adapted to dispense liquid adjacent the second end portion of the structural conduit. An external surface of the fluid tube defines a groove receiving at least a portion of a length of the flexible conduit.

In accordance with yet further aspects of the present invention, a spout assembly is provided for dispensing liquid from a nozzle. The spout assembly includes a structural conduit with a first end portion for attaching relative to a nozzle body, a second end portion for dispensing liquid, and an interior passage adapted to provide an internal flow path from the first end portion to the second end portion. A spout adapter is mounted with respect to the first end portion of the structural conduit. The spout adapter includes a pressure activated control valve adapted to permit flow of liquid into the spout assembly from a nozzle at a predetermined liquid pressure. The spout adapter further includes at least one internal adapter sidewall including a first adapter sidewall portion with a first cross-sectional dimension adapted to receive a portion of the pressure activated control valve, a second adapter sidewall portion with a second cross-sectional dimension that is smaller than the first cross-sectional dimension, and a transition location between the first and second adapter sidewall portions. The transition location provides for the change in cross-sectional dimensions between the first adapter sidewall portion and the second adapter sidewall portion. The first adapter sidewall portion includes a length at least partially defining a substantially straight liquid flow path, wherein the substantially straight liquid flow path extends through the transition location without the transition location changing the substantially straight liquid flow path. A fluid tube is disposed in the interior passage of the structural conduit and in fluid communication with the pressure activated control valve, wherein the second cross-sectional dimension of the adapter is adapted to receive a first end portion of the fluid tube, and wherein a second end portion of the fluid tube is adapted to dispense liquid adjacent the second end portion of the structural conduit.

In accordance with additional aspects of the present invention, a nozzle is provided for dispensing liquid into a container. The nozzle includes a nozzle body with an inlet for receiving liquid, an outlet for dispensing liquid, and a liquid passage extending between the inlet and the outlet. A valve assembly is adapted to selectively control the flow of liquid through the liquid passage. A spout assembly is provided for receiving and directing liquid from the outlet. The spout assembly includes a first end portion attached relative to the nozzle body and a second end portion for dispensing liquid, the spout assembly further includes at least one internal sidewall at least partially defining a liquid passage providing an internal liquid flow path in a general direction extending from the first end portion of the spout assembly to the second end portion of the spout assembly. An open-ended cavity is formed proximate to the second end portion of the spout assembly, the cavity being at least partially circumferentially disposed about the liquid passage and being operative to capture liquid flowing down the internal sidewall in the direction of the internal liquid flow path toward the second end portion of the spout assembly.

In accordance with still further aspects of the present invention, a spout assembly is provided for dispensing liquid from a nozzle. The spout assembly includes a structural conduit with a first end portion for attaching relative to a nozzle body and a second end portion for dispensing liquid. The structural conduit further comprises an interior passage providing an internal liquid flow path in a general direction from the first end portion to the second end portion, and at least one internal sidewall at least partially defining the internal liquid flow path running from the first end portion to the second end portion. Each of the first end portion and the second end portion having generally cylindrical configurations with a diameter of the internal flow path in the second end portion being reduced relative to the diameter of the internal flow path in the first end portion. An open-ended cavity is formed proximate to the second end portion of the structural conduit, the cavity being at least partially circumferentially disposed about the internal flow path and being operative to capture liquid flowing down at least one sidewall toward the second end of the structural conduit.

In accordance with still further aspects of the present invention, a nozzle is provided for dispensing liquid. The nozzle includes a nozzle body with an inlet for receiving liquid, an outlet for dispensing liquid, and a liquid passage extending between the inlet and the outlet. A valve assembly is adapted to selectively control the flow of liquid through the liquid passage. A shut-off mechanism is provided for stopping the flow of liquid through the liquid passage in response to selected predetermined conditions. A spout assembly is further provided for receiving and directing the liquid from the nozzle body outlet. The spout assembly includes a first end portion attached relative to the nozzle body and a second end portion for dispensing liquid, the spout assembly having an internal sidewall at least partially defining a liquid passage extending from the first end portion of the spout assembly to the second end portion of the spout assembly. A dual path liquid control valve is provided and is at least partially disposed in the liquid passage proximate the first end portion of the spout assembly. The dual path liquid control valve includes a primary liquid path and an auxiliary liquid path, the auxiliary liquid path having a cross-sectional flow area that is smaller than the cross-sectional flow area of the primary liquid path. A first pressure activated valve is disposed in the primary liquid path and includes a first biasing member adapted to urge the primary liquid valve to a closed position. A second pressure activated valve is disposed in the auxiliary liquid path, the second pressure activated valve includes a second biasing member adapted to urge the second pressure activated valve to a closed position, each of the first and second pressure activated valves being openable in response to liquid pressure of liquid flowing from the outlet of the nozzle body, the second pressure activated being openable in response to a lower liquid pressure than the first pressure activated valve. A venturi is located downstream of the second pressure activated valve in the auxiliary liquid path. The venturi is in fluid communication with both a liquid sensing location and the shut-off mechanism, and being operative to activate the shut-off mechanism in response to one of multiple predetermined conditions.

In accordance with still further aspects of the present invention, a spout assembly is provided for dispensing liquid from a nozzle. The spout assembly includes a structural conduit formed of a metallic material. A plurality of control components are at least partially disposed in the structural conduit. The control components are operative to control the flow of liquid through the nozzle and at least one of the control components is formed of an acetal resin material. An adhesive is provided and operative to secure at least one control component formed of an acetal resin material to at least one of the remaining control components.

In accordance with further aspects of the invention, a vacuum control mechanism is provided for use in a liquid dispensing nozzle. The vacuum control mechanism includes a fluid conduit adapted for disposition in a spout of a liquid dispensing nozzle. The fluid conduit having a liquid-sensing segment and a nozzle shut-off control segment. The liquid-sensing segment is adapted for disposition at a liquid level sensing location and shut-off control segment is adapted to communicate with a nozzle shut-off mechanism. A check valve is disposed in the fluid conduit and is operative to allow the flow of liquid through the fluid conduit in a direction from the liquid-sensing segment toward the nozzle shut-off control segment and to substantially prevent the flow of liquid in the direction from the nozzle shut-off control segment to the liquid-sensing segment.

In still further aspects of the present invention, a vacuum control mechanism is provided for use in a liquid dispensing nozzle. A fluid conduit defines a liquid flow path and is adapted for disposition in a spout of a liquid dispensing nozzle. The fluid conduit has a liquid-sensing segment and a nozzle shut-off control segment. The liquid-sensing segment is adapted for disposition at a liquid level sensing location and the shut-off control segment being is adapted to communicate with a nozzle shut-off mechanism. The nozzle shut-off mechanism is responsive to the introduction of liquid into the fluid conduit and liquid sensing segment includes at least two openings. One of the two openings serves as a vent for draining the liquid introduced into the fluid conduit.

Additional aspects of the invention will be set forth in part in the description that follows, and in part will become apparent to those skilled in the art upon examination of the following or may be learned with the practice of the invention. The aspects of the invention may be realized and attained by means of the instrumentalities and combinations particularly pointed out in the appended claims.

BRIEF DESCRIPTION OF THE DRAWINGS

While the specification concludes with claims particularly pointing out and distinctly claiming the present invention, it is believed that the same will be better understood from the following description taken in conjunction with the accompanying drawings in which:

DETAILED DESCRIPTION OF EXEMPLARY EMBODIMENTS

Figure 1:
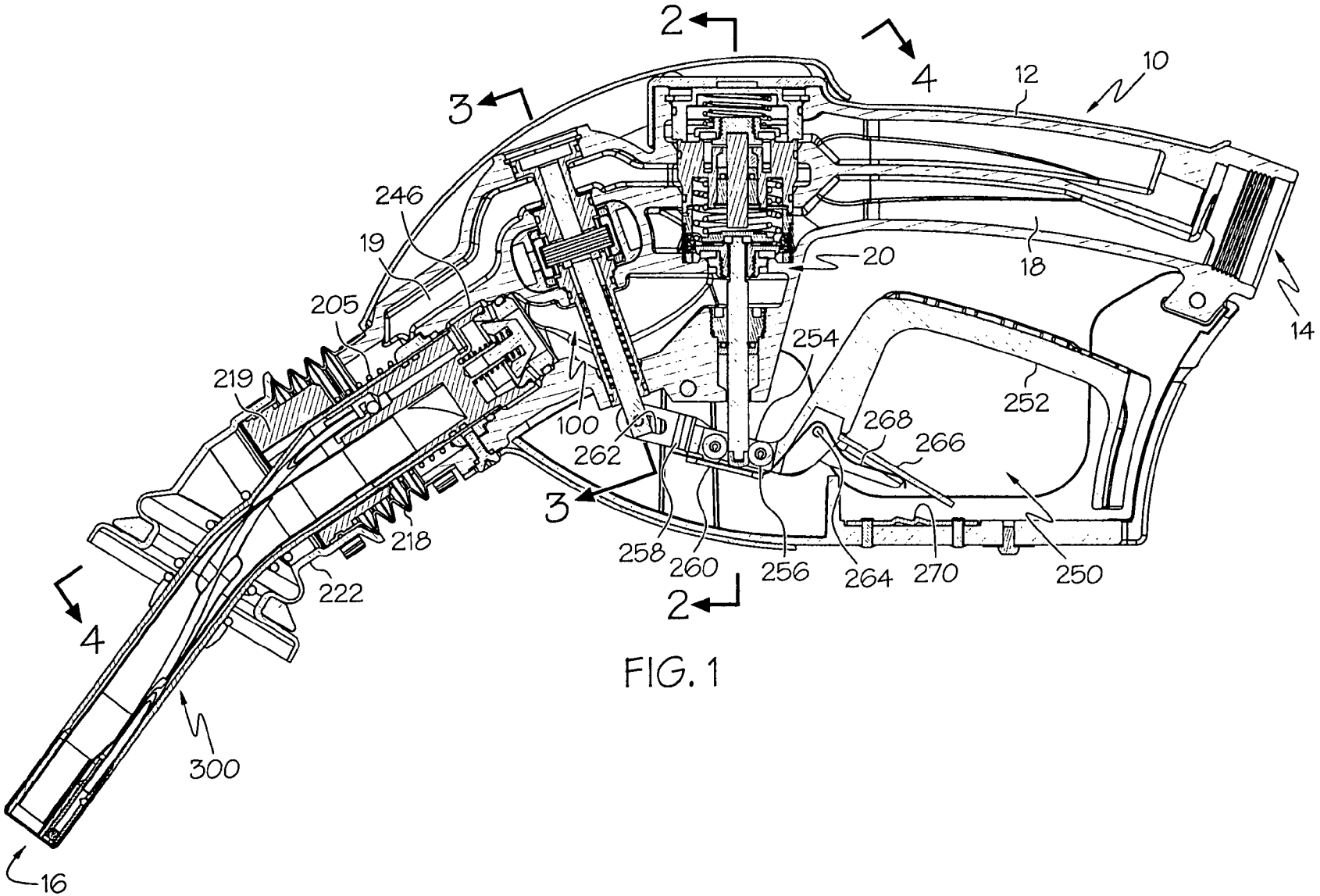
FIG. 1 is a cross sectional view of a nozzle in accordance with one exemplary embodiment of the present invention.

Turning now to the figures wherein like numbers correspond to similar elements through the views, FIG. 1 depicts a cross sectional view of a nozzle 10 in accordance with one exemplary embodiment of the present invention. Exemplary nozzles described herein may be applied in a wide variety of applications. For example, the nozzles may be used for dispensing liquid from a container. Particular exemplary applications, the nozzle may be used to dispense fuel (e.g., gasoline) from a liquid storage tank.

As shown in FIG. 1, the nozzle 10 includes a nozzle body 12 with an inlet 14 for receiving liquid. The inlet is designed to be coupled for fluid communication with a liquid storage tank. For example, a flexible hose may be coupled to the inlet 14 to permit fluid communication between a gasoline pump and the nozzle 10 at a gasoline station. In nozzle applications including a vapor recovery arrangement, the inlet 14 may be adapted to couple with a dual function hose, such as a coaxial hose including segregated vapor recovery and fluid delivery conduits. The nozzle 10 further includes an outlet 16 for dispensing liquid and a liquid passage 18 extending between the inlet 14 and the outlet 16 to facilitate dispensing of liquid with the nozzle 10.

Figure 2:
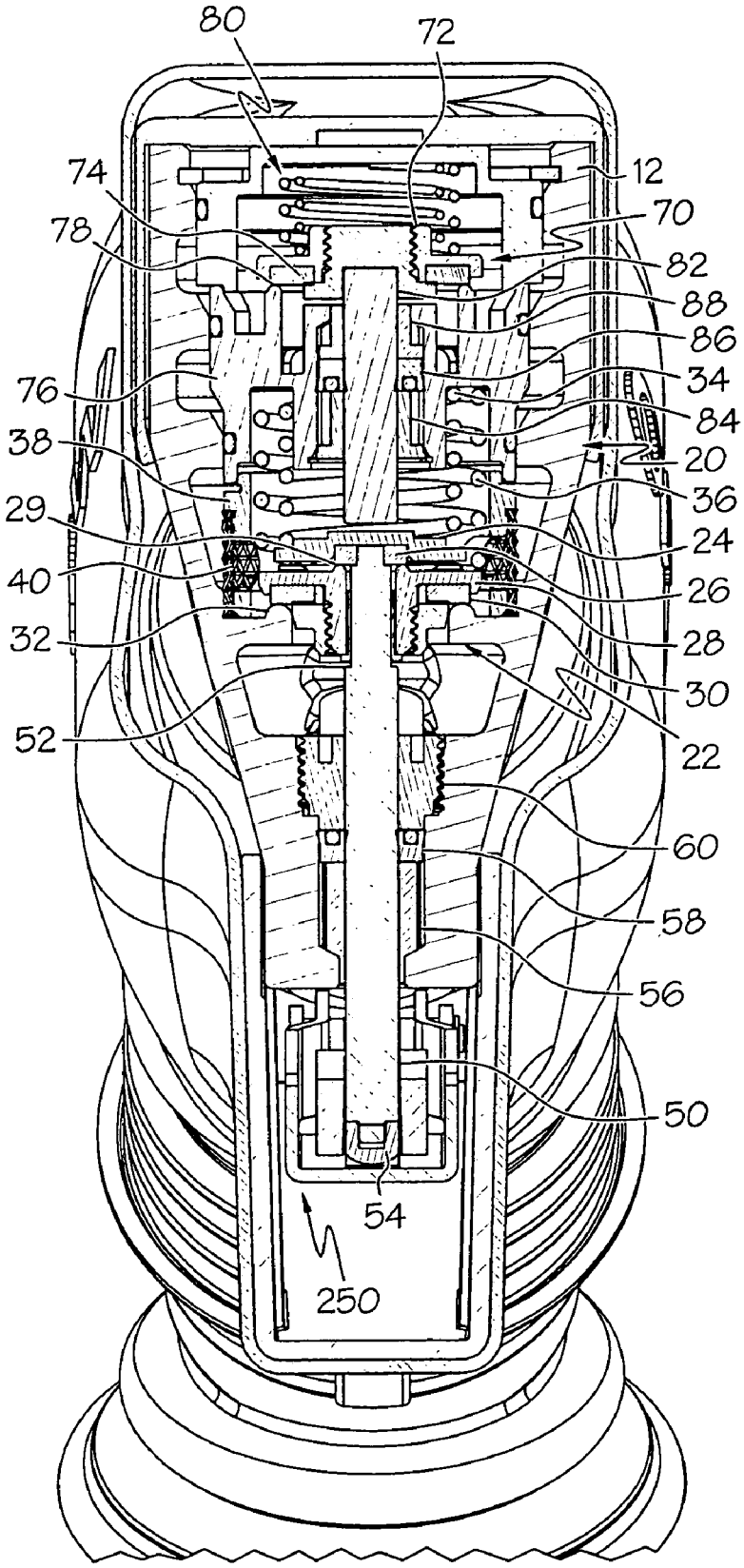
FIG. 2 is a sectional view along line 2—2 of FIG. 1, depicting aspects of the valve assembly.

The nozzle 10 further includes a valve assembly 20 for actuation by a lever 250. The valve assembly 20 is adapted to selectively control the flow of liquid through the liquid passage 18. Various valve assemblies known by those skilled in the art may be used in accordance with the inventive concepts of the present invention. FIG. 2 is a sectional view along line 2—2 of FIG. 1, depicting aspects of one exemplary valve assembly that may be used with a nozzle incorporating the inventive concepts of the present invention. The exemplary valve assembly 20 includes a liquid valve assembly 22 and a vapor valve assembly 70. The liquid valve assembly 22 includes a first valve cap 24 with a first valve seal 26 that are fixedly mounted with respect to a first valve stem 50. The liquid valve assembly 22 also includes a second valve cap 28 with a second valve seal 30 that are slidably mounted with respect to the first valve stem 50. A biasing member 34, such as a spring, is adapted to bias the first valve seal 26 against a seat 29 defined by the second valve cap 28 while another biasing member 36 is adapted to bias the second valve seal 30 against a seat 32 defined by the nozzle body 12.

A housing 38 may be associated with the liquid valve assembly 22 and supports a filter 40. The filter 40 may be beneficial to prevent debris from obstructing the contact location between the first and second seals and the corresponding seats associated therewith.

The first valve stem 50 includes a shoulder 52 adapted to permit initial disengagement of the first valve seal 26 from the seat 29 prior to disengagement of the second valve seal 30 from the seat 32 defined by the nozzle body 12. The first valve stem 50 includes a wear resistant tip 54 adapted to contact portions of the lever 250. The first valve stem 50 is adapted for reciprocation with respect to the nozzle body 12. A low friction stem guide 56 and retainer 60 may be provided to guide the first valve stem 50, reduce friction between the first valve stem 50 and the nozzle body 12, and to trap a seal 58 therebetween to prevent leakage of liquid and/or vapor from interior portions of the valve body 12.

The vapor valve assembly 70 includes a vapor valve cap 72 provided with a vapor valve seal 74. A biasing member 80, such as the illustrated springs, may be configured to bias the seal 74 against a seat 78 defined by a vapor valve housing 76. The vapor valve cap 72 and vapor valve seal 74 are mounted with respect to a vapor valve stem 82 for reciprocation relative to the vapor valve housing 76. A stem guide 84 may be provided to facilitate reciprocation of the vapor valve stem 82 with respect to the vapor valve housing 76. A vapor valve seal 86 may be further provided with a retainer 88 in order to inhibit fluid communication between vapor and liquid chambers in the nozzle body 12.

In operation, the valve stem 50 may be displaced toward the nozzle body 12 (i.e., upward as shown in FIG. 2). Initially, the first valve cap 24 and first valve seal 26 move with respect to the second valve cap 28 to disengage the first valve seal 26 from the seat 29. After further displacement of the valve stem 50, the shoulder 52 engages a lower surface of the second valve cap 28. Still further displacement permits the shoulder 52 to bias the second valve cap 28 to disengage the second valve seal 30 from the seat 32 defined by the nozzle body 12. Further displacement of the first valve stem 50 causes the first valve cap 24 to abut the bottom of the vapor valve stem 82 to cause the vapor valve seal 74 to disengage from the seat 78 of the vapor valve housing 76.

Accordingly, it will be appreciated that the liquid valve assembly 22 comprises a dual stage liquid valve arrangement to reduce the initial force necessary to actuate the valve assembly 20. Initial disengagement of the first valve seal 26 from the seat 29 reduces the overall fluid head pressure and therefore reduces the force necessary for subsequently disengaging the second valve seal 30 from the seat 32. Still further, delaying disengagement of the vapor valve seal 74 from the seat 78 minimizes vapor loss since liquid flow begins before opening the path for vapor recovery.

Figure 21:
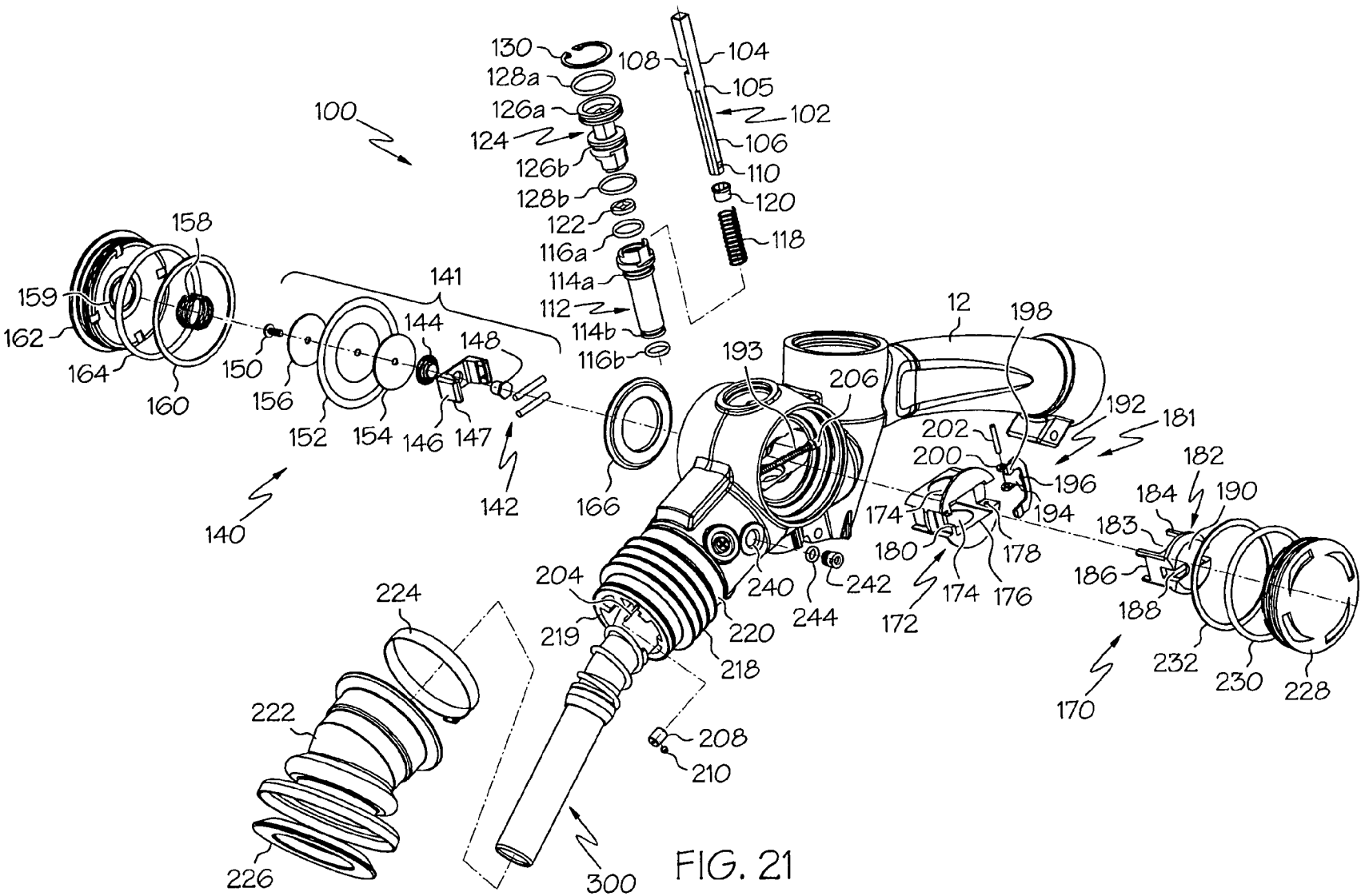
FIG. 21 is a partial exploded view of the exemplary nozzle depicted in FIG. 1
Figure 22:
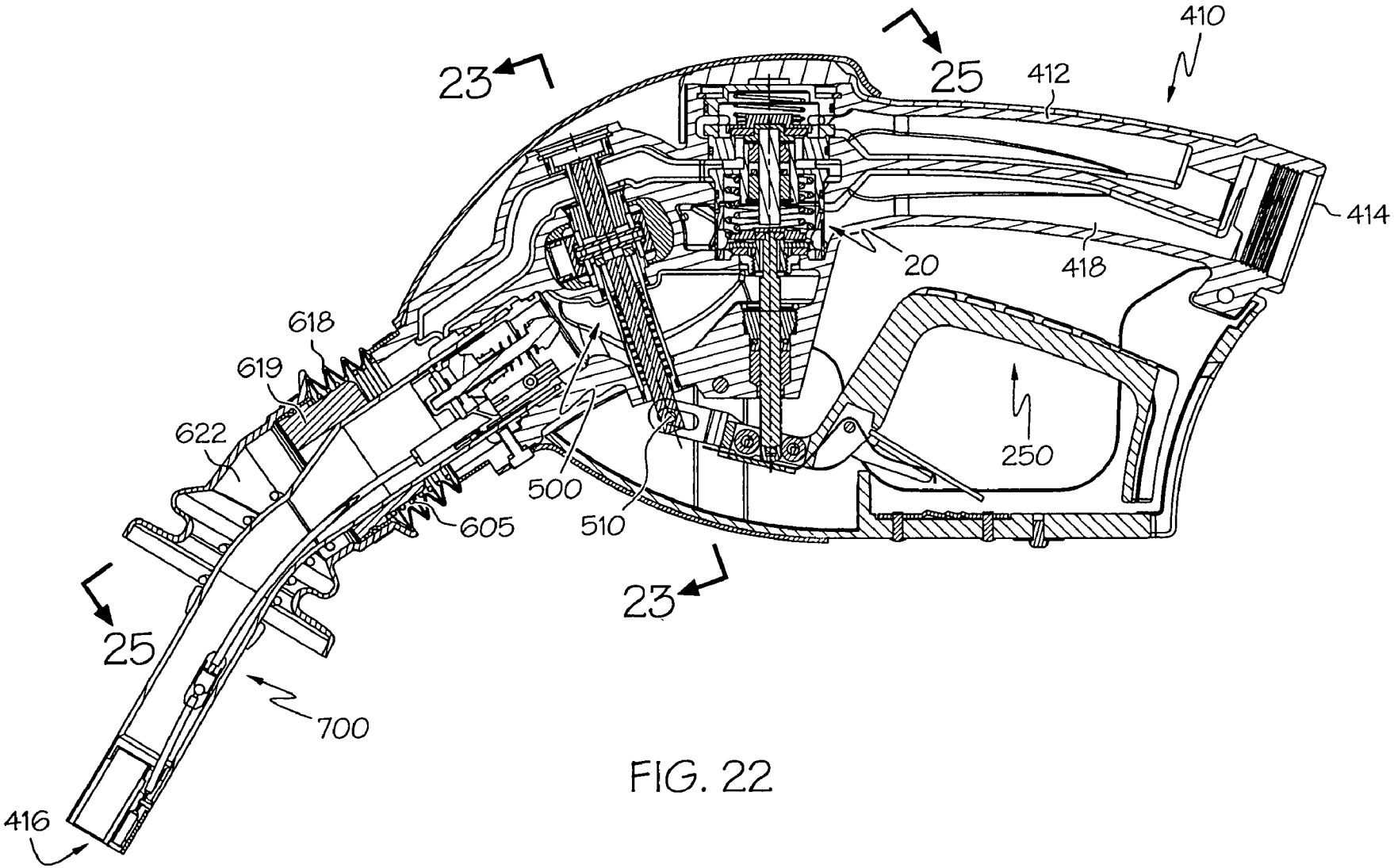
FIG. 22 is a cross sectional view of a nozzle in accordance with another exemplary embodiment of the present invention.

FIGS. 3A–3D, 4, and 21 depict aspects of an exemplary nozzle 10 in accordance with the present invention with one embodiment of a latch stem assembly 100, latch apparatus 140 and lock-out arrangement 170. As shown in FIG. 21, an exemplary latch stem assembly 100 includes a latch stem 102 with a pivot 110. The pivot 110 is illustrated as an aperture adapted to receive a retention pin for pivotal connection with the lever 250. The pivot 110 may simply comprise a location capable of providing an operable pivot for the lever 250. Moreover, as shown, the exemplary embodiment depicts the latch stem 102 as an elongated member capable of reciprocating movement with respect to the nozzle body 12. Although not shown, it is understood that the latch stem may comprise other structures that are capable of providing an operable pivot for the lever 250.

Figure 4:
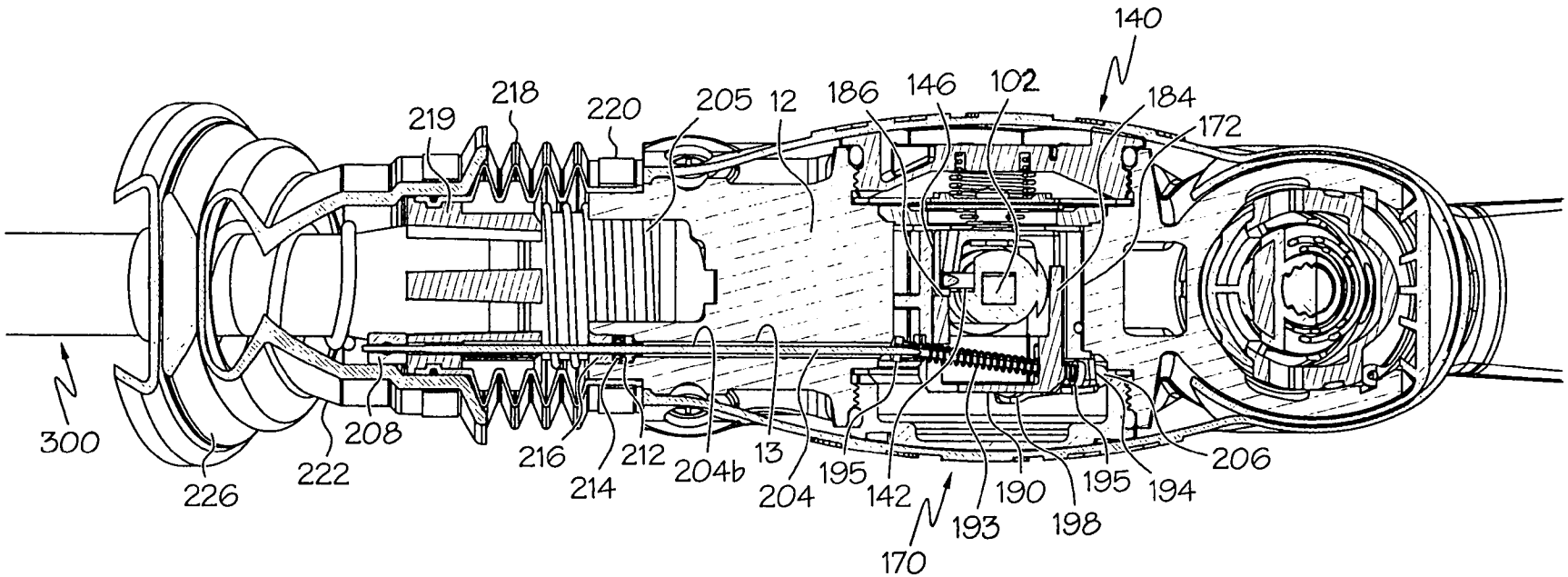
FIG. 4 is a sectional view along line 4—4 of FIG. 1, illustrating further aspects of the latch stem assembly, latch apparatus and lock-out arrangement.

The exemplary latch stem 102 illustrated in the drawings includes a first portion 104 with a latch groove 108 and a second portion 106 that includes the pivot 110. The latch groove 108 is illustrated as being disposed on one side of the latch stem 102, while the first portion 104 has a non-circular cross sectional shape (e.g., a square cross section as best shown in FIG. 4). Providing the first portion 104 with a non-circular cross section inhibits relative rotation of the latch stem 102 with respect to the nozzle body 102, thereby permitting the latch groove 108 to be properly disposed with respect to the latch apparatus 140. It is also contemplated that the latch groove may be located on more than one side and/or may extend partially or entirely around the periphery of the latch stem. Extending the groove around the periphery may be particularly useful in embodiments where the upper and/or lower portion are not keyed to permit rotation of the latch stem with respect to the nozzle body.

In exemplary embodiments, the second portion 106 of the latch stem 102 may also include a non-circular cross sectional shape to inhibit rotation of a retainer 120 with respect to the latch stem 102. As shown, the second portion 106 may have a non-circular cross section that has a different shape than the noncircular cross section of the first portion 104. For example, as shown, the second portion 106 includes a substantially square cross section with corners that are blunted or rounded such that the cross section of the second portion 106 includes four major sides transitioned by four relatively smaller intermediate sides to give the second portion 106 a general eight-sided cross section. Although not shown, the first portion 104 and the second portion 106 may also include substantially the same cross section that are rotationally offset from one another. In either case, a transition area 105 is defined between the first portion 104 and the second portion 106 that acts as a stop for the retainer 120. After engaging the stop, the retainer 120 is permitted to move with the latch stem 102 to facilitate compression of a biasing member 118, such as a spring. Throughout the application, certain biasing members are illustrated as compression springs. It is understood that other biasing members may be used with the concepts of the present invention. For example, biasing members may take the form of resilient material and/or structures capable of providing a biasing function (e.g., compression springs, leaf springs, or other resilient structural arrangements).

The latch stem assembly 100 further includes a first latch stem guide 112 and a second latch stem guide 124. The first latch stem guide 112 may be provided with a first groove 114*a* for receiving a first seal 116*a* and a second groove 114*b* for receiving a second seal 116*b*. Similarly, the second latch stem guide 124 may be provided with a first groove 126*a* for receiving a first seal 128*a* and a second groove 126*b* for receiving a second seal 128*b*. The first and second latch stem guides 112, 124 assist in providing a substantially linear path for movement of the latch stem 102 with respect to the nozzle body 12 while isolating internal areas of the nozzle 10.

Figure 3A:
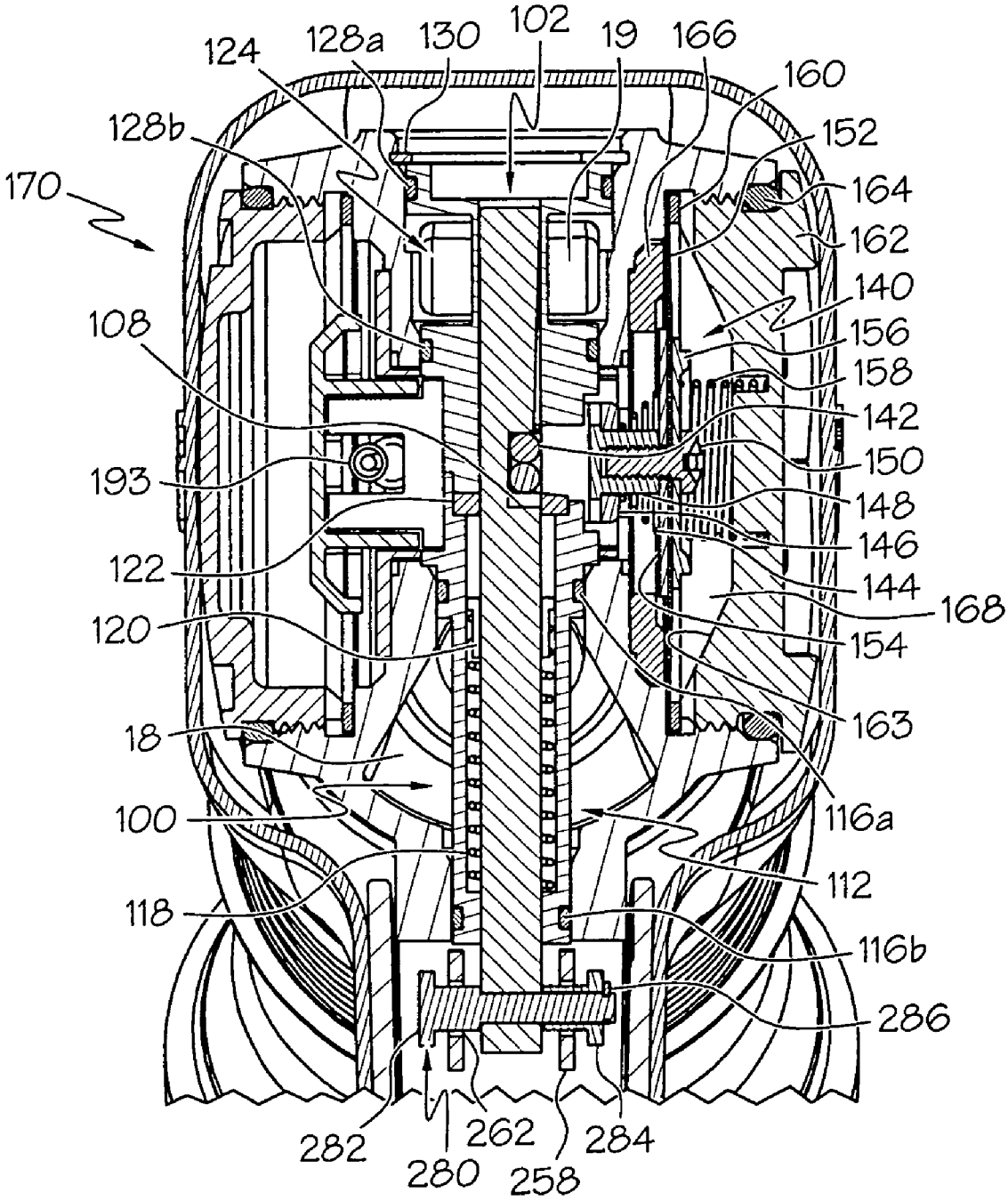
FIG. 3A is a sectional view along line 3—3 of FIG. 1, depicting aspects of the latch stem assembly, latch apparatus and lock-out arrangement, wherein a latch member is arranged in a locked position with respect to a latch stem to provide an operable pivot.

Referring to FIGS. 3A and 21, the latch stem assembly 100 may be installed by first inserting the first latch stem guide 112 into the nozzle body 12 to provide a guide for the latch stem 102 while positioning the first seal 116*a* and the second seal 116*b* to isolate the liquid passage 18 from internal areas of the nozzle 10. Next, the biasing member 118 is inserted into an interior area of the first latch stem guide 112 followed by the retainer 120. A latch member guide 122 is then placed over the first portion 104 of the latch stem and, as described more fully below, facilitates placement of a latch member 142 with respect to the latch stem groove 108. The latch member guide may be fabricated from a wear resistant material, such as stainless steel, to reduce wearing of portions of the latch stem 102 adjacent the latch groove 108. Finally, the second latch stem guide 124 is placed over the first portion 104 of the latch stem and locked in place, together with the previously-described latch stem assembly components with a retaining ring 130. As best shown in FIG. 3A, the first and second seals 128*a*, 128*b* of the second latch stem guide 124 permit isolation of the vapor recovery passage 19 from internal areas of the nozzle 10.

The nozzle 10 may further include the exemplary latch apparatus 140. As depicted in FIGS. 3A and 21, the latch apparatus 140 includes a latch member 142 adapted to be at least partially received by the latch groove 108 of the latch stem 102. As shown, one exemplary embodiment of a latch member 142 may comprise two or more rollers that are rotatably mounted to lateral arms 147 for rotation relative to a carrier 146. The rotational arrangement of the rollers 142 with respect to the carrier 146 reduces friction and wear between the latch member 142 and latch groove 108. It is contemplated the that latch member may comprise other structures that perform the function of entering at least partially into the latch groove 108 to inhibit movement between the latch stem 102 and the nozzle body 12. For example, the latch member may comprise a single roller, one or more ball bearings, or the like. Still further, the latch member may comprise a friction reducing material to further reduce wear and may also be nonrotatable to simplify the production process by allowing a fabrication of the latch member and carrier as one integral piece. In nonrotatable latch member embodiments, fabricating the latch member from a low friction material may be particularly useful to reduce frictional forces between the latch member and latch groove.

One or more biasing members (e.g., compression spring) can be provided to urge the latch member 142 into the latch groove 108. In the particular depicted embodiment, the biasing member 144 is provided for biasing the latch member 142 away from a diaphragm 152 while another biasing member 158 biases the diaphragm away from an opposed rigid wall 163 of a vacuum cap 162. With this exemplary arrangement, the latch member 142 is mounted with respect to the carrier 146 and adapted to be at least partially received by the latch groove 108. The carrier 146 and the diaphragm 152 are adapted to move relative to one another. To facilitate relative movement, a spacer 148 may be attached relative to the diaphragm 152 and the carrier 146 may be slidably received on the spacer 148.

As shown, the diaphragm 152 may be provided with first washer 154 adapted to provide a bearing surface for the biasing member 144 and a second washer 156 adapted to provide a bearing surface for the biasing member 158. The first and second washers 154, 156 can also provide a certain degree of rigidity to the central portion of the diaphragm 152 by discouraging and/or preventing flexing of the diaphragm 152 in a direction too far towards the latch stem 102. For example, the first and second washers 154, 156 may discourage and/or prevent flexing of the diaphragm 152 by the biasing member 158 past the position shown in FIG. 3A. In fact, the biasing member 158 may press against the second washer 156 to displace the central portion of the diaphragm 152 toward the latch stem 102 until the first washer 154 engages a diaphragm spacer 166 as shown in FIG. 3A.

Assembly of the latch apparatus 140 to the nozzle body 12 is best described with reference to FIG. 21. A subassembly 141 is first fabricated by mounting the latch member 142 with respect to the carrier 146. The carrier 146 may then be slidably received on the spacer 148 and the biasing member 144 may further be placed with respect to the spacer 148. A fastener 150, such as a bolt, may then be inserted through apertures defined in the washers 154, 156 and the diaphragm 152 to be threaded into the spacer 148 (see FIG. 3A).

Once the subassembly 141 is fabricated, a diaphragm spacer 166 is inserted into an interior portion of the nozzle body 12. Next, the subassembly 141 is inserted with respect to the diaphragm spacer 166. A peripheral edge of the diaphragm 152 is sandwiched between a portion of the nozzle body 12 and a thrust washer 160. The thrust washer 160 may comprise a low friction material such as a low friction plastic. Next, the biasing member 158 is placed with an end portion located within an annular groove 159 of the vacuum cap 162 and a seal 164 is placed with respect to a sealing location of the vacuum cap 162. Finally, the vacuum cap 162 is torqued down such that the thrust washer 160 is pressed against the peripheral edge of the diaphragm 152 to hold the diaphragm in place with respect to the nozzle body 12. Once the vacuum cap 162 is torqued down, a vacuum chamber 168 is formed including a volume at least partially defined by the diaphragm 152 and the opposed rigid wall 163.

FIGS. 4 and 21 best illustrate exemplary embodiments of a lock-out arrangement 170 that is adapted to unlock the latch stem 102 with respect to the nozzle body 12 to release the pivot, thereby hindering actuation of the valve assembly by the lever. For example, unlocking of the latch stem releases the pivot such that the handle is not effective to actuate the valve assembly even if the user has the handle squeezed in its normal dispense position.

In exemplary embodiments, the lock-out arrangement 170 includes a sensor 204 adapted to facilitate unlocking of the latch stem 102 with respect to the nozzle body 12. In fuel dispensing applications, the sensor 204 is adapted to respond to engagement of portions of the nozzle with a vehicle body portion to reduce the likelihood if inadvertent distribution of fuel to the surrounding environment. For example, the sensor 204 may be adapted to respond to compression of the bellows structure of a nozzle after the spout is properly inserted into the fuel tank. Therefore, embodiments of the lock-out arrangement 170 of the present invention are capable reducing inadvertent fuel spills that may otherwise prove damaging to the surrounding environment.

As shown, the exemplary sensor 204 may comprise a substantially elongated flexible member that is threaded through portions of the nozzle body 12. While many types of substantially elongated flexible members may be used, exemplary embodiments of the present invention include a cable as illustrated in the drawings. Providing the sensor 204 as a substantially elongated flexible member permits a sensing arrangement that requires less clearance area, therefore allowing the substantially elongated flexible member to be threaded through interior areas of the nozzle. For example, as shown in FIG. 4, the substantially elongated flexible member 204 is threaded through a sensor channel 13 defined in the nozzle body 12.

The sensor 204 used with the lock-out arrangement might be a one-way sensor or a two-way sensor. A one-way sensor is arranged such that it generally provides a single directional sensing function while a two-way sensor arrangement may provide a dual directional sensing function. As shown in the illustrated embodiments, the sensor 204 comprises a one-way sensor due to the flexibility of the cable and the fact that the ends of the cable are defined with one-ways tops 206, 208 such that compression of the bellows 218 causes the cable to either flex or the ends to disengage the guide 219 and or link 192.

In contrast, a substantially elongated rigid member might require a relatively larger amount of interior clearance space to operate properly, thereby substantially increasing the size of the nozzle. The overall nozzle size may be substantially reduced by extending the substantially elongated rigid member substantially offset from the nozzle body, rather than extending the sensor through the body. However, extending a substantially elongated rigid member exterior of the nozzle body may create possible dangerous pinch points and the sensor may be exposed to external environmental conditions that might damage the sensor.

On the other hand, in accordance additional embodiments of the present invention, it might be desirable to provide a sensor that comprises a substantially elongated rigid structure. While the substantially elongated rigid structure may require additional space and clearance to avoid interference with the nozzle body, the substantially elongated rigid structure might comprise a more rugged structure for applications where a stronger sensor structure is desired.

Still further, the sensor might comprise a structure that is not substantially elongated in nature. For example, a sensor may comprise a proximity indicator such as a pressure transducer that may transmit a signal with infrared transmitter, or the like, to an independent actuating device. Proximity indicators may be useful in applications to reduce the requirement of a mechanical linkage extending from one location on the nozzle to another location on the nozzle. Therefore, the nozzle may be streamlined to reduce nozzle size and the mechanical structures of the nozzle may be further simplified to reduce manufacturing costs. However, a substantially elongated member may be used in applications to prevent failure of the nozzle or in fuel dispensing applications where an electrical sensing mechanism might provide a potential hazard with flammable fluid.

As shown in the drawings, the sensor comprises a substantially elongated flexible member 204 that is threaded through a sensor channel 13 defined in the nozzle body 12. As shown in FIG. 4, the nozzle 10 may also be provided with a wear reducing structure associated with the substantially elongated flexible member 204. A wear reducing structure may function to reduce and/or prevent structural failure of the elongated flexible member and may also reduce friction to enhance the sensor function of the substantially elongated flexible member. In exemplary embodiments, the wear reducing structure may include a layer 204*b* (see FIG. 4) of material provided adjacent at least a portion of an exterior surface of the substantially elongated flexible member 204. As shown, the wear reducing structure may also include one or more bushings 216 attached with respect to the nozzle body 12. While the exemplary embodiments discussed and illustrated throughout this application have a wear reducing structure as comprising both a bushing 216 and a layer 204*b* of material, it is understood that the wear reducing structure may comprise one of the bushing 216 or the layer 204*b* of material. A guide 212 and seal 214 may be provided to assist in positioning the substantially elongated flexible member 204 with respect to the sensor channel 13 while preventing leakage of fluid and/or vapor from interior portions of the nozzle body 12. Still further, it is understood that the guide 212 and/or seal 214 may also function as a wear reducing structure. In additional embodiments, a wear reducing structure may not be required. For example, the substantially elongated flexible member itself might be fabricated with material such that the sensor comprises a substantially flexible elongated wear resistant member.

In the illustrated exemplary embodiment, the lock-out arrangement 170 may further include a pusher 181 adapted to engage the latch apparatus 140. A first end of the sensor 204 is positioned relative to the pusher 181 to facilitate engagement of the latch apparatus 140 by the pusher 181. In the illustrated embodiment, the pusher 181 can include an engagement member 182 adapted for linear movement relative to the nozzle body 12 and a link 192 adapted to pivot relative to the nozzle body 12. The exemplary engagement member 182 includes four engagement legs 184 and an engagement shoulder 186 disposed between each pair of vertical pairs of legs 184. The four engagement legs 184 and two engagement shoulders 186 are designed to be inserted into a guide member 172 adapted to be inserted into an interior area of the nozzle body 12.

The link 192 is illustrated as a substantially L-shaped link with a base portion 194 and at least one engagement arm 198 extending away from the base portion 194. The base portion 194 is pivotally connected with respect to the nozzle body 12. For example, as shown, the base portion 194 includes a pair of pivot tabs 200 that are pivotally connected with a pivot pin 202 to the guide member 172 adjacent pivot apertures 178 defined in the guide member 172.

In the illustrated embodiment (see FIG. 4), the lock-out arrangement 170 may further include a biasing member 205 adapted to apply tension to the sensor 204. A second end of the sensor 204 is positioned relative to a portion of the biasing member 205 to apply tension to the sensor 204. As shown, the biasing member 205 may comprise a compression spring that applies a force against a guide 219 that in turn applies tension to the sensor 204.

To assemble the lock-out arrangement 170, the link 192 is first pivotally connected to the guide member 172 with pivot pin 202. Next, the guide member 172, together with the link 192 are inserted an interior portion of the nozzle body 12. A pair of aligned apertures 174 permit subsequent mounting of the first latch stem guide 112. Next, with the engagement arms 198 of the link 192 pivoted away, the engagement legs 184 and engagement shoulders 186 of the engagement member 182 is inserted into a guide channel 176 defined by the guide member 172. Access areas 183 between the upper pair of engagement legs 184 and lower pair of engagement legs 184 allow the subsequently mounted first latch stem guide 112 to be straddled by the upper and lower pairs of engagement legs 184. The link 192 is then pivoted with respect to the guide member 172 until the engagement arm 198 abuts against an engagement surface 190 of the engagement member 182. Next, the second end of the sensor 204 is threaded through an aperture 196 defined in the base portion 194, through one or more cable access channels 188 defined in the engagement member 182, through a cable access groove 180 defined in the guide member 172, through sensor channel 13 defined in the nozzle body 12, through the guide 121, seal 214 and bushing 216, through the guide 219. The sensor 204 is pulled through until a stop 206 engages and outer surface of the base portion 194 of the link 192. Next, the guide 219 is forced to compress the biasing member 205 and then a clamping arrangement including a stop 208 and set screw 210 are installed relative to the second end of the elongated flexible member 204 such that the precompressed biasing member 205 causes tension in the substantially flexible member 204 to bias the engagement arm 198 of the link 192 against the engagement surface 250 of the link 192. Once installed, a reinforcement ring 226 is installed on an end of a shroud 222 and the shroud 222 is then attached to the flexible bellows 218 with a shroud clamp 224 and the flexible bellows 218 is then attached to the nozzle body 12 with a bellows clamp 220. When installing the sensor 204, a link biasing member 193 and end caps 195 may be installed (see especially FIG. 4. The end caps 195 act as stops for the spring 193 and the biasing member 193 may comprise a compression spring that presses against the link base portion 194 to rotate the link 192 and therefore the engagement arms 198 away from the engagement surface 190 of the engagement member 182 when the tension is released from the sensor 204. Finally, a thrust washer 232 is installed with a side cap 228 and seal 230 arrangement.

Specifics of the lever 250 is shown, for example, with reference to FIGS. 1 and 3A. The lever includes a first lever portion 252, a second lever portion 258 and a latch member 266 pivotally attached to one another at a common pivot 264. The second lever portion is pivotally attached to the location 110 of the latch stem 102. In particular, as best shown in FIG. 3A, a retention pin 280 is inserted into an aperture at the location 110 to facilitate pivotable mounting of the second lever portion 258 to the latch stem 102. To reduce friction forces, the retention pin 280 may be rotatably mounted at the location 110 such that the retention pin 280 may freely rotate relative to the latch stem 102. The retention pin includes a head 282 that acts as a lateral stop to maintain the retention pin 280 in place. At least one first rotatable member 284 may also be disposed to contact the retention pin 280. For example, the first rotatable member 284 may comprise a roller that is mounted to an end of the retention pin 280 with a snap ring 286 or other fastening arrangement. Therefore, exemplary embodiments of the present invention permit for the latch stem 102, retention pin 280 and first rotatable member 284 to provide a pivot point for the second lever portion 258 when the latch stem is in the operative position.

While the illustrated embodiment depicts a roller, it is understood that one or more rotatable members may be incorporated and the rotatable members may comprise other structures such as one or more rotatable ball bearings. As shown, the retention pin 280 and the first rotatable member 284 are independently rotatable relative to one another. Independent relative rotation further reduces friction since the sides of the second lever portion 258 (see FIG. 3A) contact the retention pin 280 and first rotatable member 284 at different locations. Therefore, relative movement between the sides is permitted with reduced friction. As shown, only one side of the retention pin 280 is provided with the first rotatable member 284. It is understood that the retention pin 280 may be provided without the head 282 and include a structural arrangement with an additional rotatable member 284.

The first lever portion 252 includes a follower end 254 adapted to receive a lower portion of the first valve stem 50 while acting as a pivoting stop to limit pivotal movement of the second lever portion 258 with respect to the first lever portion 252. Turning back to FIG. 1, the follower end 254 is further provided with at least one second rotatable member 256 to further reduce frictional forces. As shown, the second rotatable member 156 comprises two rollers that are independently rotatable about separate, parallel axes and positioned to contact opposed locations of the first valve stem 50.

In use, when the latch stem 102 is locked with respect to the nozzle body 12 to provide an operable pivot, actuation of the valve assembly 20 by the lever 250 is permitted. For example, the first lever portion 252 may be moved upwardly and the second lever portion 258 may then rotate with respect to the first lever portion until a strike plate 260 of the second lever portion 258 contacts a lower surface of the follower end 254 which acts as a rotational stop to prevent further relative rotation between the first lever portion 252 and the second lever portion 258. Further upward pivoting movement causes the first lever portion 252 and the second lever portion 258 to rotate as a single unit about the pivot location 110 of the latch stem 102. The strike plate 260 of the second lever portion 258 then engages the first valve stem 50 to unseat seals from the valve assembly 20 as described above.

A latch member 266 may also be provided to allow hands-free filling with the nozzle. In operation, the latch member 266 may be pivoted down, against the force of the biasing member 268, to engage a rack 270 of the nozzle. If the latch stem 102 is unlocked with respect to the nozzle body 12 to release the pivot location 110 while the handle 250 is compressed, the latch stem 102 will be release and the second lever portion 258 will then pivot downward from the follower end 258 about a common pivot 264. The downward movement of the follower end 258 will provide further force to the biasing member 268 to cause the latch 266 to disengage the rack 270. As the follower end 258 pivots, the retention pin 280 and first rotatable member 284 slide within a pivot slot 262 of the second lever portion 258. Moreover, the first valve stem 50 will reciprocate down with respect to the follower end 254. To reduce friction, the at least one second rotatable member 256 provides for reduced friction following of the first valve stem 50 through the follower end 254.

The pivot connection between the latch stem 102 and the second lever portion 258 with the first rotatable member 284 and the following of the first valve stem 50 with the second rotatable member 256 allows for reduced friction when operating the lever. Reduced friction in this regard is especially useful with a dual-stage valve arrangement. The dual-stage valve arrangement is designed for activation with a reduced amount of pressure to the first lever portion 252. Therefore, reduced friction will be desirable to prevent instances where the first stage valve is activated even after the latch stem 102 is released due to friction between the latch stem and the second lever portion 258. In fuel dispensing applications, inadvertent activation of the valve assembly when the latch stem 102 is released may result in hazardous dispensing of fuel to the surrounding environment.

Figure 3B:
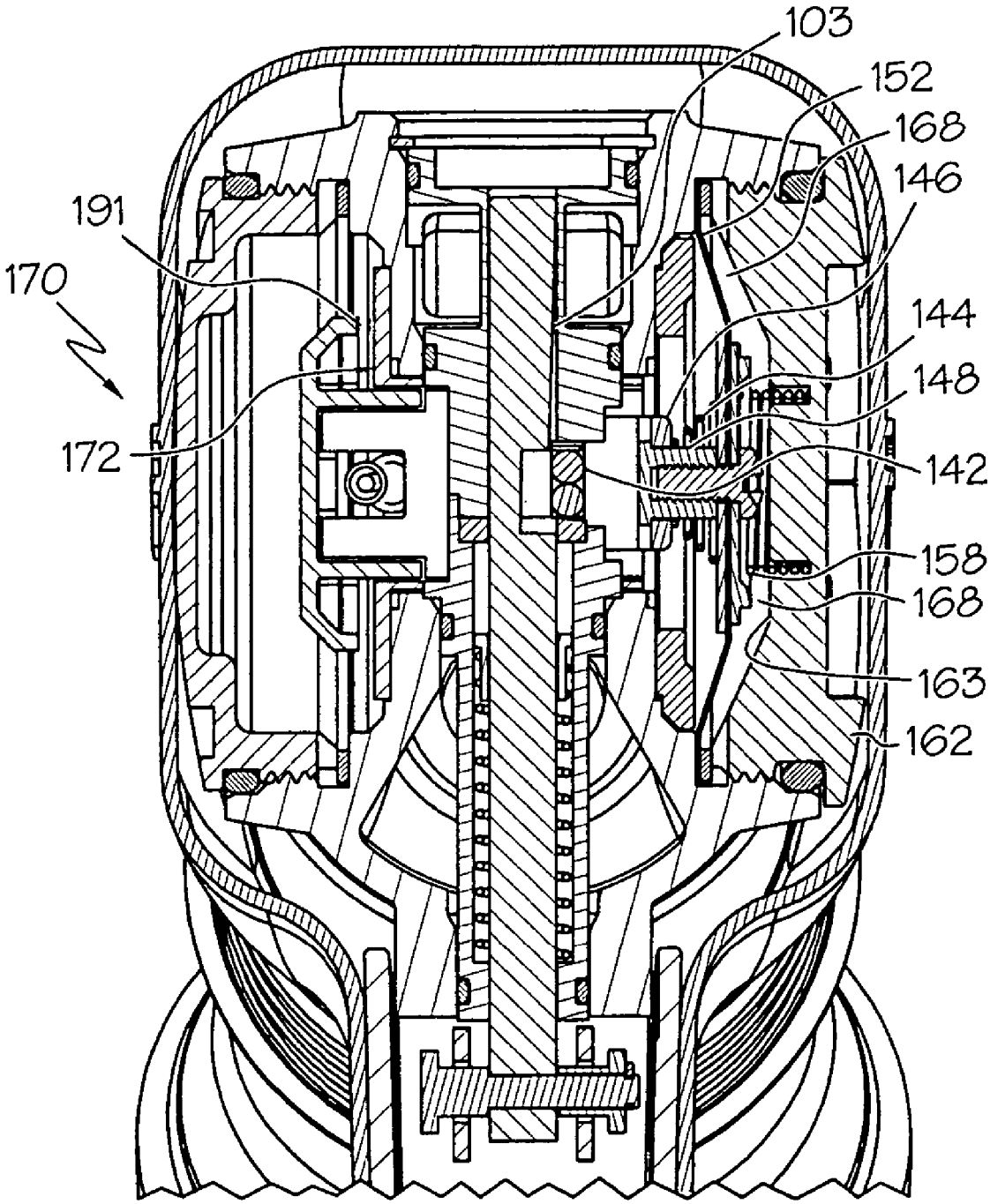
FIG. 3B is a sectional view similar to FIG. 3A, wherein the latch member is arranged in a first unlocked position with respect to the latch stem due to a predetermined liquid level being reached in the storage tank.
Figure 3C:
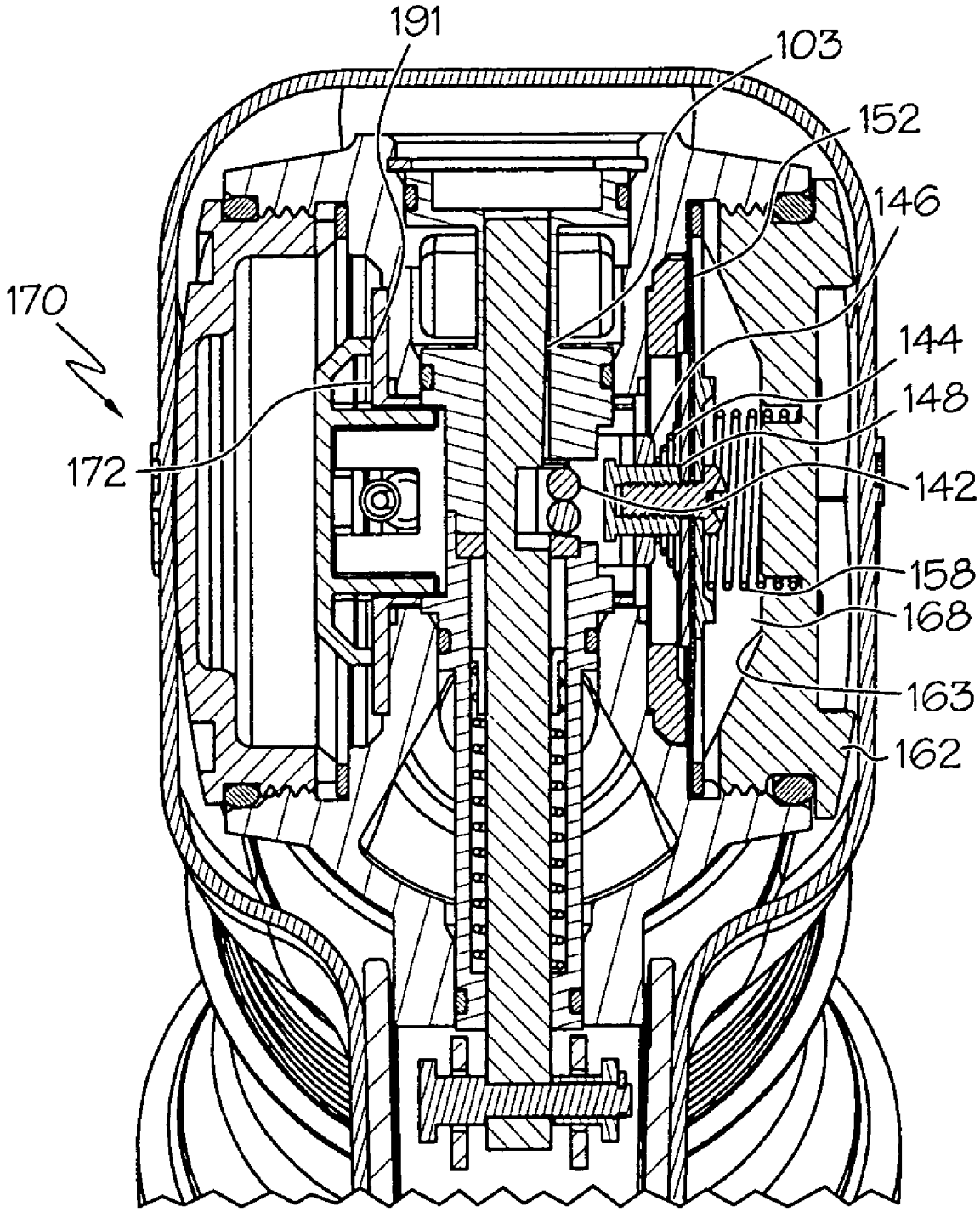
FIG. 3C is a sectional view similar to FIG. 3A, wherein the latch member is arranged in a second unlocked position with respect to the latch stem resulting from the nozzle not being properly engaged with the storage tank.

An exemplary arrangement of the nozzle components in a non-use position will now be described with reference to the nozzle discussed above. FIGS. 1 and 3C depict the nozzle 10 with components in a nonuse position. In the nonuse position, the compression spring 205 is preloaded in compression to cause the compression spring to bias the guide 219 away from the nozzle body 12. As shown in FIG. 4, movement of the guide 219 away from the nozzle body 12 causes the guide 219 to press against the one-way stop 208 to take up slack in the sensor 204 and apply tension to the sensor 204.

As further shown in FIG. 4, tension in the sensor 204 pulls the base portion 194 to cause the link 192 to pivot about the pivot pin 202, countering the force of the biasing member 193, thereby causing the engagement arm 198 to press against the engagement surface 190 of the engagement member 182. Each vertical pair of engagement legs 184 of the engagement member 182 straddles a corresponding lateral arm 147 of the carrier 146 such that the shoulder 186 of the engagement member 182 engages the outer surface of a corresponding lateral arm 174 (See especially 186 in FIG. 4). Therefore the force applied by the engagement arm 198 of the link 192 causes the engagement member 182 to push the carrier 146 away from the latch stem assembly 100 to at least partially move the latch member 142 out of the latch groove 108 defined in the latch stem 102.

For example, as shown in FIG. 3C, the engagement member 182 pressed by the link 192 until an outer circumferential portion 191 abuts the guide member 172. As the engagement member is pressed by the link 192 to the position shown in FIG. 3C, the engagement member 182 counters the force exerted by biasing member 144 such that the carrier 146, together with the latch member 142 move toward the diaphragm 152.

The stiffness of the compression spring 158 may be significantly higher than the stiffness of compression spring 158 such the diaphragm 152 remains substantially stationary with respect to the rigid wall 163 of a vacuum cap 162 as the carrier 146 moves toward the diaphragm 152. Therefore, a volume of a vacuum chamber 168 defined at least partially by the diaphragm 152 and the rigid wall 163 may remain substantially constant as the carrier 146 moves toward the diaphragm 152. This arrangement is particularly useful to prevent a pumping action of the vacuum chamber 169 during an automatic shut off due to sensing of liquid by the spout end of the nozzle. Undesirable pumping may otherwise uptake small amounts of fluid that may be drawn out of the tank and dispensed into the environment.

As shown in FIG. 3C (and FIG. 3B described below), the latch member 142 is illustrated as being entirely removed from the latch groove 108. It is understood, however, that the latch member 142 may be designed for partial removal from the latch groove 108 by the pusher 181. For example, due to the cylindrical surface and and/or pivotable mounting of the rollers 142 with respect to the carrier 146, the latch member may be partially moved out of the latch groove 108 so an upper edge of the latch groove 108 is adapted to engage an off-center upper portion of the roller, wherein the edge will push the latch member outward due to the upper cylindrical nature of the latch member. In addition, or alternatively, the latch stem 102 may be designed to facilitate removal of the latch member from the latch groove 108. As shown in FIG. 3C, for example, an upper portion of the latch stem 102 above the latch groove 108 may have a ramped cam surface 103. Downward movement of the latch stem 102 will therefore cause the ramped cam surface 103 to engage the latch member 142 and push the latch member out of the latch groove 108 and toward the diaphragm 152.

Thus, when the spout of a nozzle 10 is not properly inserted into a fuel tank of a vehicle, the biasing member 205 causes tension in the sensor 104, wherein, above a predetermined level of tension, the lock-out arrangement 170 is adapted to release the pivot as described above. Any attempt to squeeze the lever 250 will not activate the valve assembly 20 but will result in downward movement of the latch stem 102 with respect to the nozzle body 12 as illustrated by the arrow 101 in FIG. 3D. Releasing the lever will allow the latch stem biasing member 118 to bias the latch stem 102 back in the position shown in FIG. 3C wherein the pivot remains released until the spout of the nozzle is properly inserted in the fuel tank of the vehicle.

In order to provide an operable pivot for the lever, the spout of the nozzle must be properly inserted into the opening of a fuel tank for a vehicle. Thus, with reference to FIGS. 1 and 3A, in order to provide an operable pivot, an operator will first insert the spout of the nozzle 10 into the opening of the fuel tank of a vehicle. Eventually the shroud 222 will engage the exterior of the vehicle such that the end of the shroud substantially circumscribes the opening of the fuel tank to facilitate vapor recovery from the fuel tank. As the spout is inserted further, the bellows 218 is compressed with the guide 219 to further compress the compression spring 205, thereby releasing tension from the sensor 205. The biasing member 144 is then permitted to cause the carrier 146 to slide relative to the spacer 148 and toward the latch stem 102 wherein the latch member 142 enters into the latch groove 108 to lock the latch stem 102 with respect to the nozzle body 12 to provide an operable pivot to facilitate actuation of the valve assembly 20 by the lever 250.

Once in the position illustrated in FIG. 3A, the lever 250 may be pivoted about the location 110 of the latch stem 102 that provides the operable pivot to begin dispensing liquid. After liquid dispensing has begun, two conditions may cause unlocking of the latch stem 102 with respect to the nozzle body 12 to release the pivot to hinder actuation of the valve assembly by the lever 250. In particular, the nozzle may be disengaged from the tank (which is sensed by the sensor 204), or a vacuum condition occurs in the vacuum chamber 168 that releases the pivot.

Figure 3D:
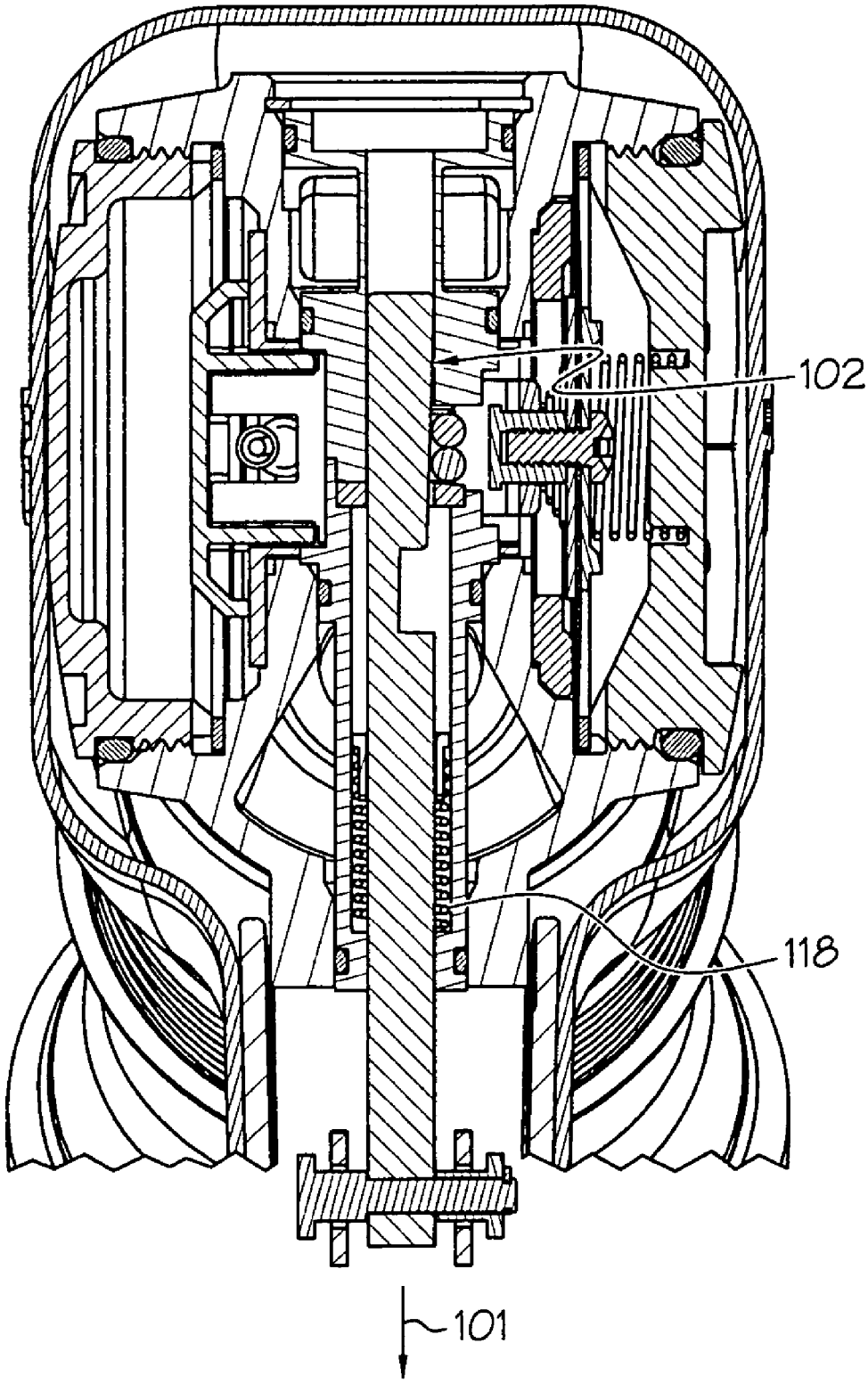
FIG. 3D is a sectional view similar to FIG. 3C, wherein subsequent pressure to a lever causes downward movement of the latch stem since the latch member is arranged in the second unlocked position.

If the nozzle is disengaged from the tank, the lock-out arrangement 170 will unlock the latch stem 102 with respect to the nozzle body 12 to release the pivot such that the latch member 142 is moved at least partially out of the latch groove 108 as described above and as illustrated with respect to FIG. 3C. Since the latch stem 102 is in an unlocked condition, pressure being applied to the handle results in downward movement of the latch stem 102 in the direction 101 as shown in FIG. 3D. Moreover, since the carrier slides relative to the spacer 148 without substantial relative movement of the diaphragm 152 relative to the rigid wall 163, the volume within vacuum chamber 168 remains substantially constant and therefore does not uptake an amount of liquid through the sensing end of the nozzle.

A vacuum condition in the vacuum chamber 168 can also act to unlock the latch stem 102 with respect to the nozzle body 12 to release the pivot location 110 releases the pivot to hinder actuation of the valve assembly 20 by the lever 250. For example, as shown in FIG. 3B, significant underpressure within the vacuum chamber 158 will cause the diaphragm 152 to flex toward the rigid wall 163. An end of the spacer 148 then engages the carrier 146 to pull the latch member 142 at least partially out of the latch groove 108 of the latch stem 102, thereby unlocking the latch stem 102 with respect to the nozzle body 12 to release the pivot to hinder actuation of the valve assembly 20 by the lever 250. Since the latch stem 102 is in an unlocked condition, pressure being applied to the handle results in downward movement of the latch stem, thereby removing the operable pivot location.

It will be appreciated that the latch stem 102, as described above, may be selectively locked with respect to the nozzle body 12 to prevent activation of the nozzle prior to insertion with respect to a container. Moreover, if certain conditions are met, as described with respect to the nozzle assembly 300 below, an underpressure in the pressure chamber 168 may cause unlocking of the latch stem 102 to prevent further dispensing of liquid. In fuel dispensing applications, the nozzle in accordance with the present invention may prevent or reduce inadvertent fuel spills and fuel vapor leakage to the environment.

Figure 5:
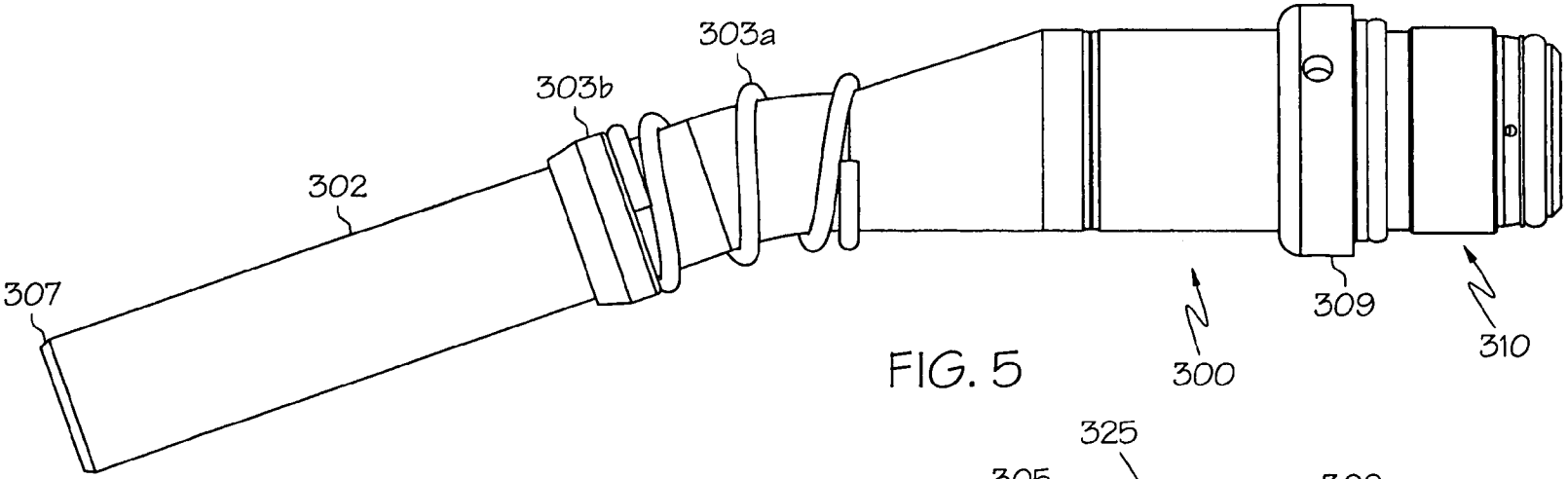
FIG. 5 is an elevational view of a spout assembly in accordance with an embodiment of the invention.
Figure 6:
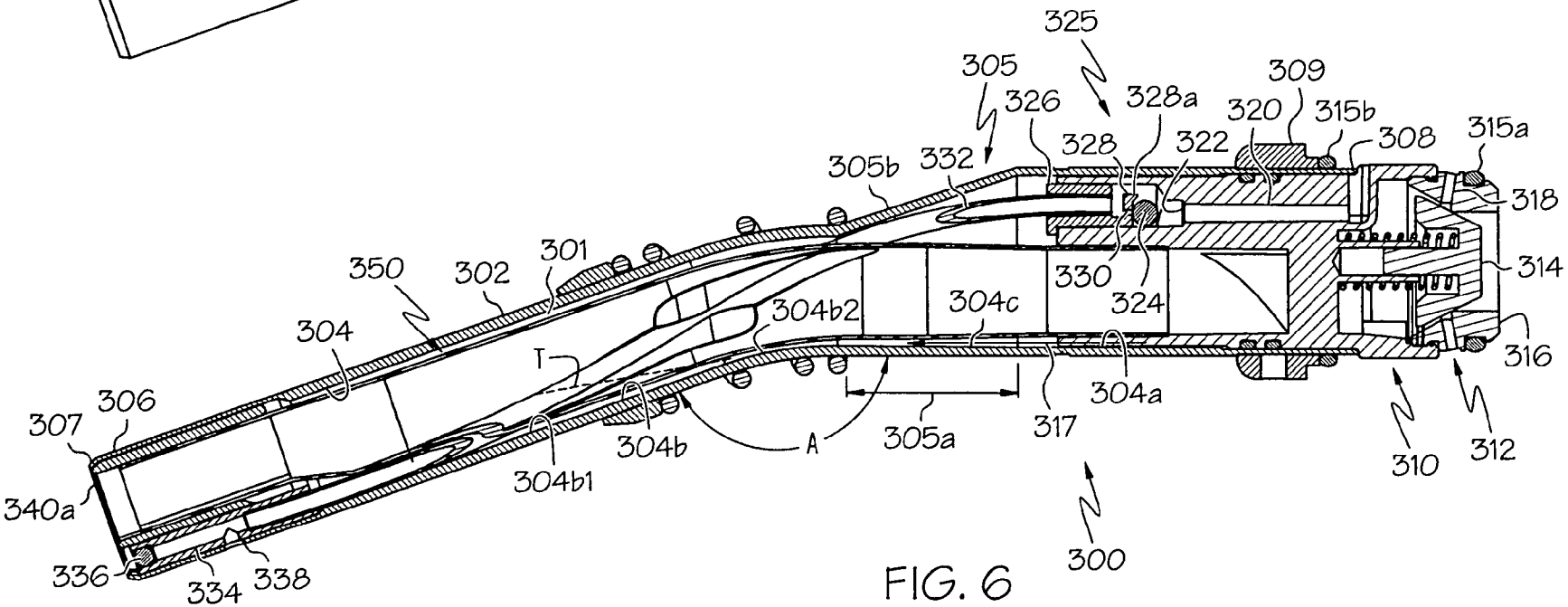
FIG. 6 is a sectional view of the spout assembly of FIG. 5.
Figure 7:
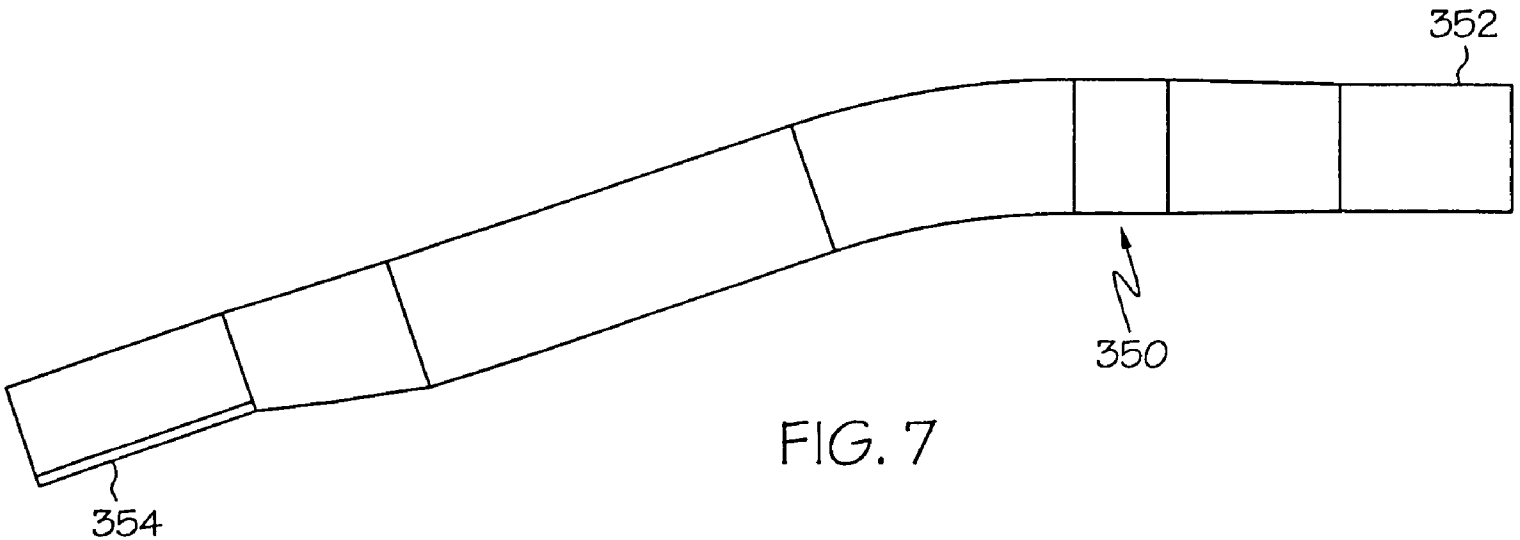
FIG. 7 is an elevational view of a fluid tube.
Figure 8:
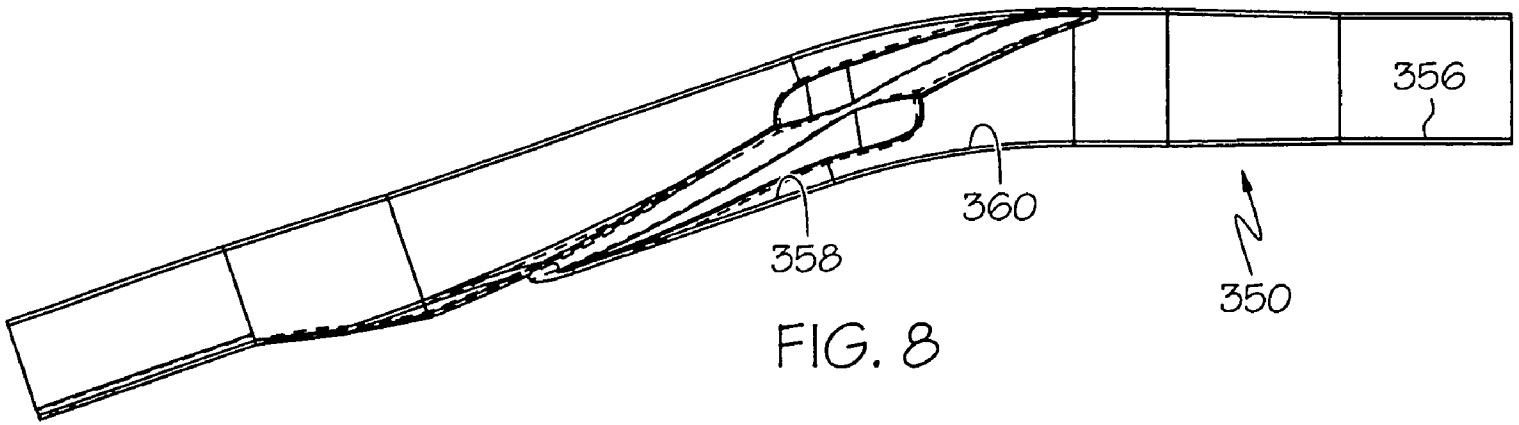
FIG. 8 is a sectional view of the fluid tube of FIG. 7.
Figure 9:
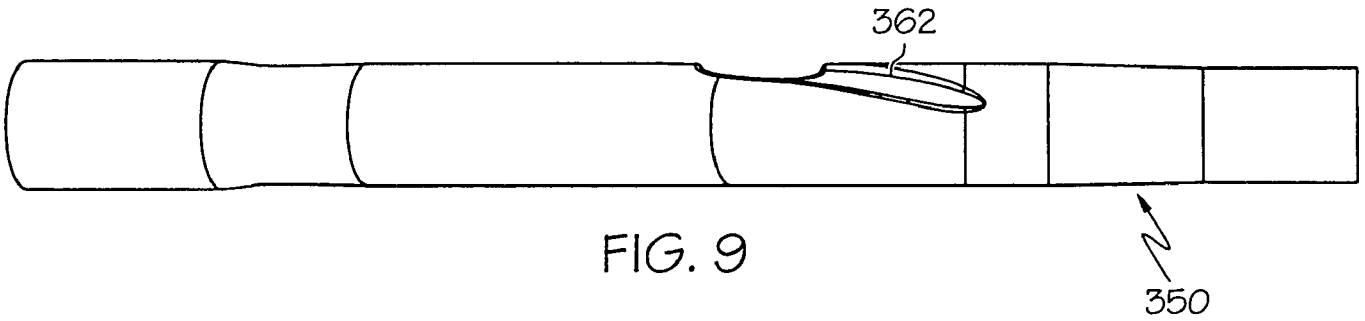
FIG. 9 is a top view of the fluid tube of FIG. 7.
Figure 10:
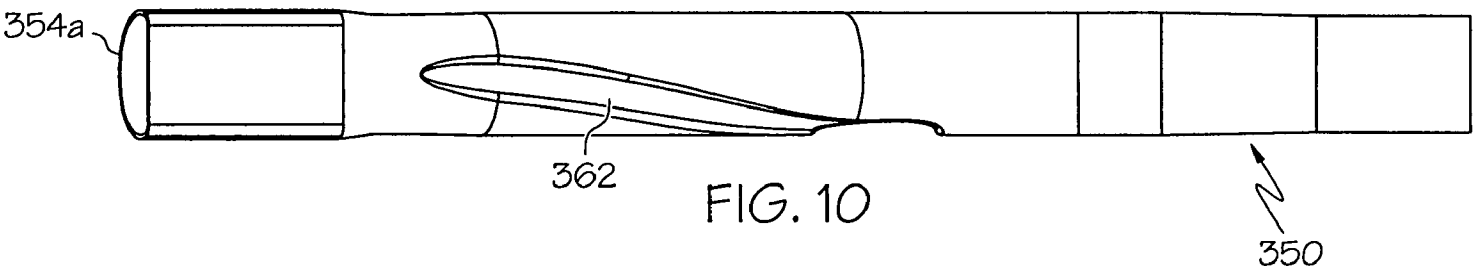
FIG. 10 is a bottom view of the fluid tube of FIG. 7.
Figure 11:
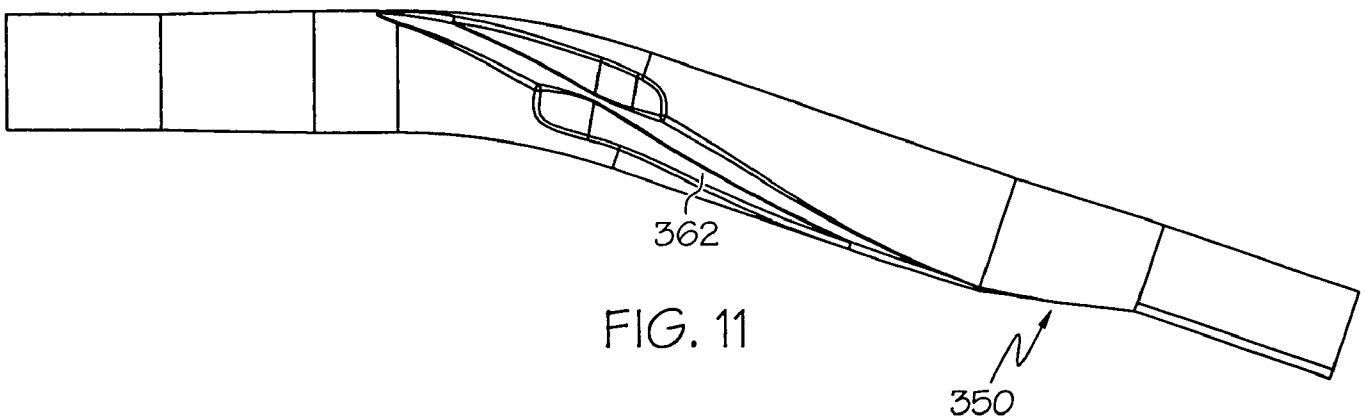
FIG. 11 is a rear view of the fluid tube of FIG. 7.

A spout assembly 300 for dispensing liquid from a nozzle is now described with respect to the exemplary embodiment appearing in FIGS. 5—20 below. An exterior view of a nozzle assembly 300 appears in FIG. 5. The nozzle assembly 300 includes a structural conduit 302 that may be attached to the nozzle body 12 with a mounting flange 309. As best shown in FIG. 1, fasteners extend through the nozzle body 12 and into the mounting flange 309 to attach the nozzle assembly to the nozzle body 12. The nozzle further includes an engagement structure 303*a* and a retaining ring 303*b* to trap the engagement structure 303*a* on the exterior of the structural conduit 302. FIG. 6 illustrates a sectional view of the nozzle assembly of FIG. 5. The structural conduit includes a first end portion 308 for attaching relative to a nozzle body 12 and a second end portion 306 for dispensing liquid.

Specifics of one exemplary structural conduit 302 will now be described with reference to FIG. 6. Concepts of the present invention may be practiced with different structural conduit arrangements. However, structural conduits with the features described with reference to the exemplary embodiments illustrated herein may reduce environmental spillage by providing a structural conduit with an internal sidewall that is adapted to substantially prevent pooling of liquid being dispensed from the nozzle. For example, as shown, an interior passage 301 of the structural conduit 302 provides an internal flow path 351 from the first end portion 308 to the second end portion 306. At least one internal sidewall 304 includes a first sidewall portion 304*a* with a first cross-sectional dimension and a second sidewall portion 304*b* with a second cross-sectional dimension that is smaller than the first cross-sectional dimension. Still further, the internal sidewall 304 includes a transition location 305 between the first sidewall portion 304*a* and the second sidewall portion 304*b* wherein the transition location provides for the change in cross-sectional dimensions between the first sidewall portion and the second sidewall portion. As shown in FIG. 6, the first sidewall portion 304*a* includes a length (also indicated with reference number 304*a* in FIG. 6) at least partially defining a substantially straight liquid flow path 317. As further shown, the substantially straight liquid flow path 317 extends through the transition location without the transition location changing the substantially straight liquid flow path. As shown the transition location can include a third sidewall portion 304*c* that further defines the substantially straight liquid flow path. In this case, the transition location has a length along 305*a* that is substantially straight relative to the angled upper portions 305*b* of the transition location. Therefore, the upper portions 305*b* provide an angular relationship that provides for the change in cross-sectional dimensions between the first sidewall portion 304*a* and the second sidewall portion 304*b*. As further illustrated, the transition location 305 may have successive cross sections along the substantially straight liquid flow path that define a plurality of substantially circular cross-sectional shapes defining a plurality of successively smaller diameters.

While the transition location 305 is shown having a length (also indicated as 304*c* in FIG. 6), it is contemplated that the transition location 305 may have a finite length or substantially no length. For instance, angular upper portions 305*b* may comprise a step transition with an approximate normal angular orientation between the first sidewall portion 304*a* and the second sidewall portion 304*b* at the upper locations. In this embodiment, the transition location may simply immediately transition the first and second sidewall portions without the transition location changing the substantially straight liquid flow path.

In exemplary embodiments, the first sidewall portion 304*a* and the second sidewall portion 304*b* have a substantially circular cross-sectional shape wherein the first and second cross-sectional dimensions comprise respective diameters of the first and second sidewall portions. In this instance, the transition location may comprise an asymmetrically tapered section to alter the cross-sectional area of the internal liquid flow path from a first inside diameter of the liquid flow path adjacent the first end portion 308 to a second inside diameter of the liquid flow path adjacent a second end portion 306. The lower portion of the substantially circular cross-sectional shape may have a slightly flattened portion to provide a slight planar surface on the lower portion of the channel in exemplary embodiments without interfering with the substantially circular cross-sectional shape of the structural conduit.

The second sidewall portion 304*b* may optionally include a substantially straight section 304$b_1$ and an curved portion 304$b_2$. The curved portion 304$b_2$ provides an angular orientation between the first sidewall portion 304*a* and the second sidewall portion 304*b*. As shown, the substantially straight liquid flow path 317 defined at least partially by a length of the first transition portion 304*a* extends at an obtuse angle "A" with respect to a substantially straight liquid flow path defined by a length of the second end portion 306. The curved portion 304$b_2$ has an imaginary tangential line "T" that extends through each point along the curved portion 304$b_2$. Each imaginary tangential line of the curved portion extends at an interior angle with respect to the substantially straight liquid flow path 317 in the range of about 180° to about the obtuse internal angle "A". To provide a smooth curve that prevents pooling of liquid, the interior angle of each tangential line is successively smaller along the curved portion 304$b_2$ from the first sidewall portion 304*a* to the second sidewall portion 304*b*.

Therefore, as discussed above, the structural relationships between the first, second and third sidewall portions permit reduction of diameter will pooling of liquid may be prevented by providing the substantially straight liquid flow path 317 that is not interrupted by the transition location 305.

In accordance with additional aspects of the present invention, the spout assembly may include a spout adapter 310 mounted with respect to the first end portion 308 of the structural conduit 302. The spout adapter includes a pressure activated control valve 312 mounted to an opening 311*a* of a spout adapter body portion 311. Placement of the pressure activated control valve 312 the first end portion 308 of the structural conduit 302 upstream within the structural conduit 302 may allow the fluid to second end portion 306 of the structural conduit 302 in a more developed flow pattern and may tend to prevent turbulence, and problems associated therewith, in the fluid discharge.

The pressure activated control valve 312 includes a poppet 314 mounted for reciprocation with respect to a valve seat 316. O-rings 315*a* and 315*b* may be used to provide a fluid seal between the nozzle body 12 and the spout assembly 300 and further function at least partially define a venturi area 246 (see FIG. 1) once the spout assembly 300 is mounted with respect to the nozzle body 12. The valve seat 316 includes a venturi conduit 318 that is in fluid communication with a venturi channel 320 after the spout assembly 300 is installed with respect to the nozzle body 12. The venturi conduit 318 is in fluid communication with a sensing opening 338 located at the second end portion 306 of the structural conduit 302.

The spout adapter 310 may include an optional attitude device 325. The attitude device 325 can be designed to shut off liquid dispensing if the spout assembly 300 is tilted beyond a predetermined angle. For example, FIG. 6 shows an orientation of the nozzle wherein the substantially straight liquid flow path 317 is substantially horizontal with respect to gravity when a user is dispensing fluel. If the user tilts the spout assembly any further clockwise, as depicted in FIG. 6, a closing body 324, such as a ball bearing, may move to obstruct an opening 322 to cause an underpressure condition in the venturi channel 320. This underpressure is conveyed to the vacuum chamber 168 which caused diaphragm 152 flex, as illustrated in FIG. 3B, to pull the latch member 142 at least partially out of the latch groove 108 to unlock the latch stem 102 with respect to the nozzle body 12 as described above. Therefore, the attitude device 325 can discourage orientation of the spout assembly in angular positions that are clockwise from the position shown in FIG. 6, thereby, discouraging of pooling of liquid within the nozzle assembly 300.

Exemplary attitude devices 325 may include a structure, such as an attitude plug 326, to trap the closing body 324 within an area of the adapter 310. The attitude device may also comprise a bridge 328 as part of the plug for example. If a bridge is provided, an overhang portion 328*a* may be provided to restrain a movement of the closing body 325 within the area of the spout adapter 310. Alternatively, or in addition, exemplary bridges may further include an aperture 330 adapted to facilitate a pressure differential to bias the closing body 324 against the bridge 328 unless the spout assembly is tilted beyond a predetermined angle. If provided, the dimensions of the aperture 330 can be adjusted to change the pressure differential, and therefore the biasing influence to adjust the predetermined angular position necessary to permit the closing body 324 to move over and thereafter obstruct the opening 322.

Figure 12:
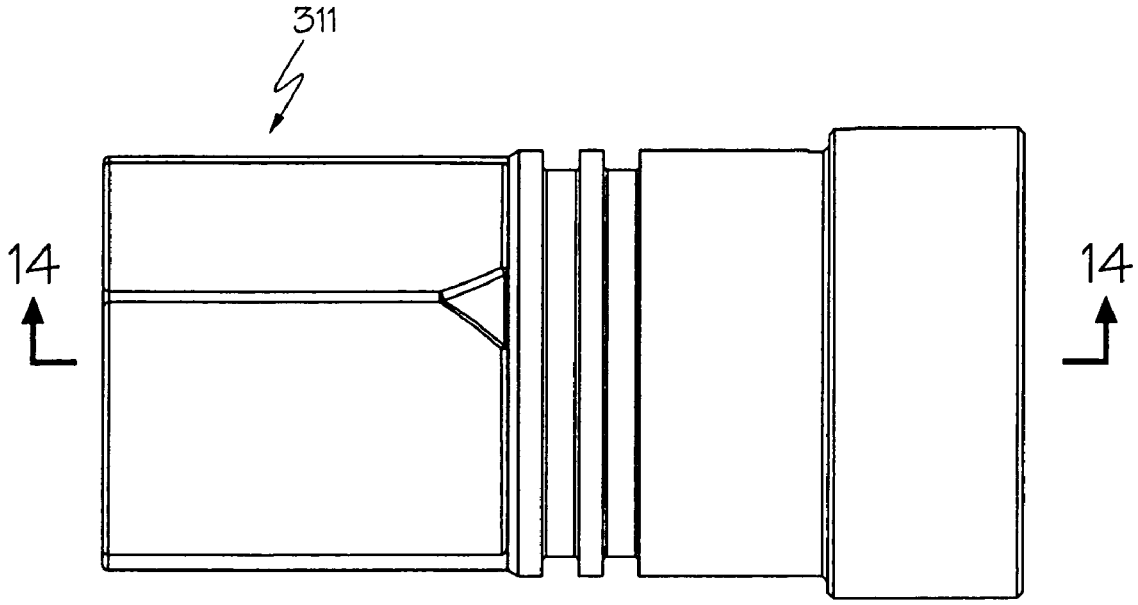
FIG. 12 is an elevational view of an adapter body.
Figure 13:
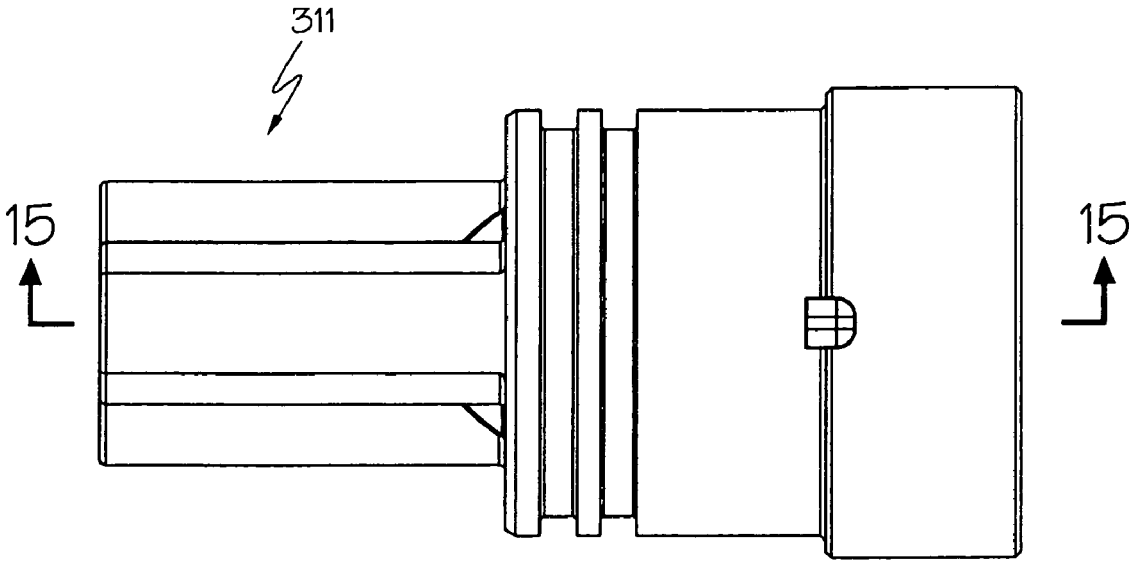
FIG. 13 is a top view of the adapter body of FIG. 12.
Figure 14:
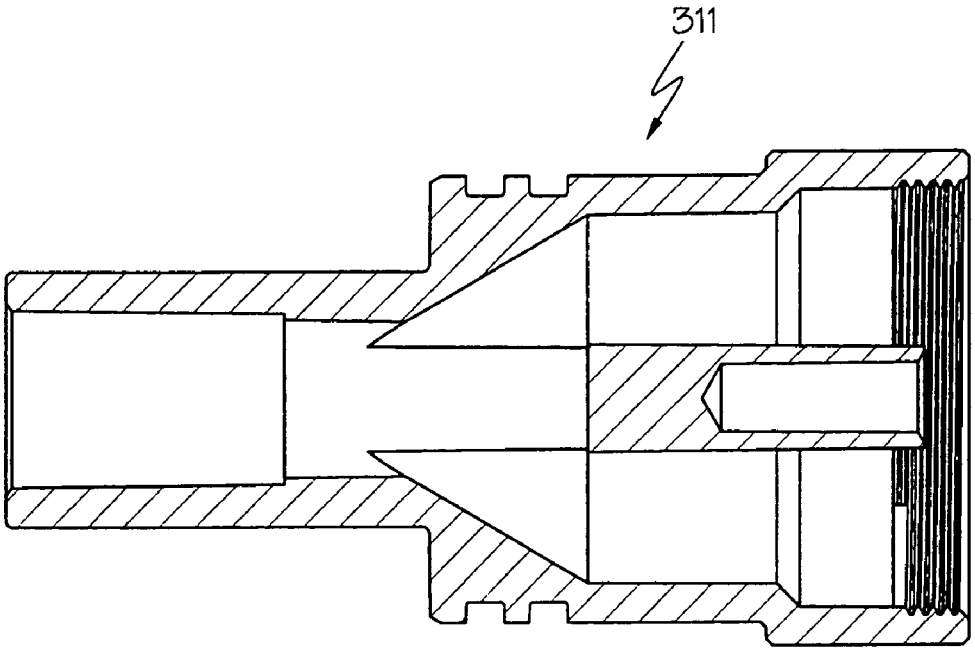
FIG. 14 is a sectional view of the adapter body along line 14—14 of FIG. 12.
Figure 15:
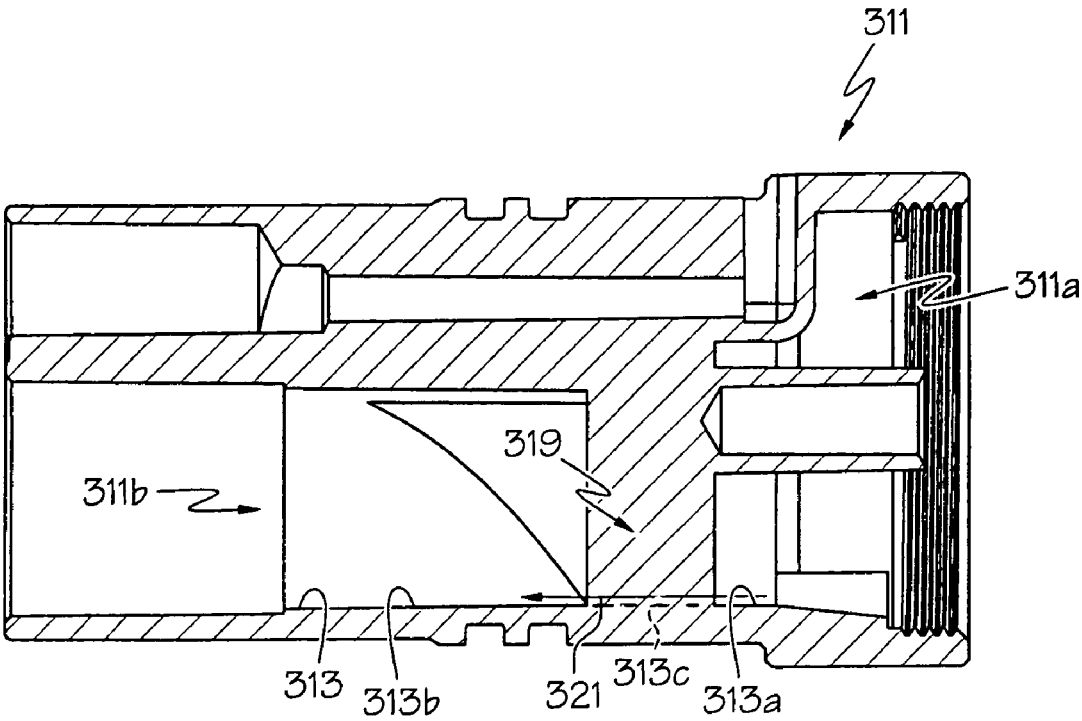
FIG. 15 is as sectional view of the adapter body along line 15—15 of FIG. 13.
Figure 16:
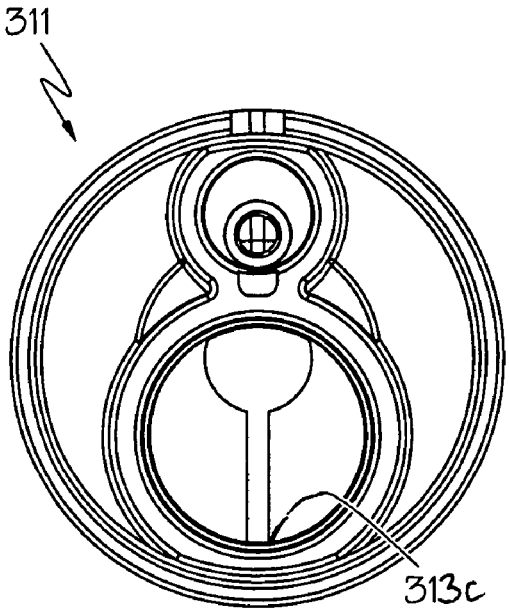
FIG. 16 is a left side view of the adapter body of FIG. 12.
Figure 17:
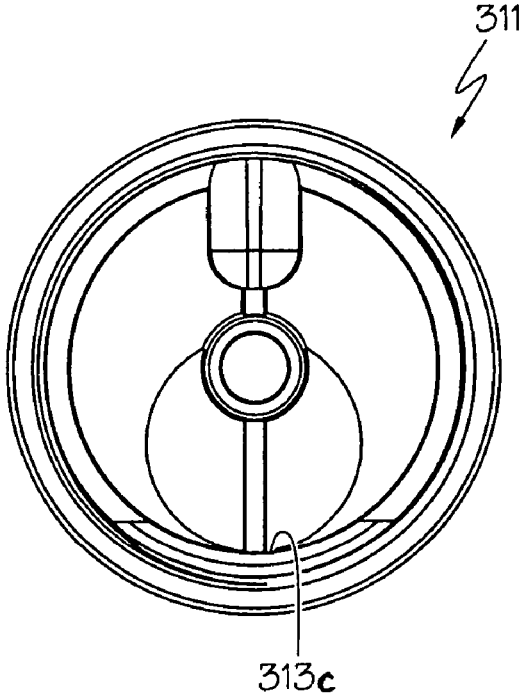
FIG. 17 is a right side view of the adapter body of FIG. 12.

Spout adapter body portions 311 of the present invention may have a wide variety of structural shapes. In particular embodiments, the structural shapes of the body portions 311 may be selected to prevent pooling of liquid in the end of the spout assembly. An elevational side view and top view of an exemplary adapter body portion is illustrated in FIGS. 12 and 13 respectively and respective cross sections appear in FIGS. 14 and 15. With respect to FIG. 15, the spout adapter body portion 311 includes an opening 311*b* for a fluid tube 350 as well as the opening 311*a* for the pressure activated control valve 312 described above. The spout adapter body portion 311 further includes at least one adapter internal sidewall 313 with a first and second adapter sidewall portion 313*a*, 313*b* and an adapter transition location 319 that have similar or identical features with the first and second sidewall portion 304*a*, 304*b* and the transition portion 304*c* of the structural conduit 302 described above. These similar or identical features further prevent pooling of liquid within the nozzle adapter body portion 311. Indeed, as shown in FIG. 15, the first adapter sidewall portion 313*a* includes a first adapter cross-sectional dimension (e.g., circular) and the second adapter sidewall portion 313*b* includes a second adapter cross-sectional dimension that is smaller than the first adapter cross-sectional dimension. The adapter transition location 319 is located between the first and second adapter sidewall portions and provides for the change in cross-sectional dimensions between the first adapter sidewall portion and the second adapter sidewall portion. As shown, the first adapter sidewall portion 313*a* includes a length (also indicated as 313*a* in FIG. 15) that at least partially defines a substantially straight adapter liquid flow path 321 that extends through the adapter transition location 319 without the adapter transition location changing the substantially straight adapter liquid flow path 321. As shown in FIGS. 16 and 17, in exemplary embodiments, the first and second sidewall portions comprise circular cross sections that are joined by an asymmetrically tapered transition location.

As shown in FIGS. 6—11, the spout assembly includes a fluid tube 350 for directing fluid to be dispensed by the spout assembly. The fluid tube includes a first end portion 352 adapted to be received in the opening 311*b* of the adapter 310 and a second end portion 354 adapted to be received in an opening 342 of the ferrule 340. The fluid tube 350 includes a first internal sidewall portion 356 and a second internal sidewall portion 358 with a transition portion 360. The first and second sidewall portions have substantially straight portions while the transition portion includes a smooth curved transition between the first and second sidewall portions. Therefore, the arrangement of the internal sidewall portions 356, 358 with the transition portion 360 is designed to prevent pooling of liquid within the fluid tube 350.

A flexible conduit 332 may be presented to provide fluid communication between the venturi channel 320 and the sensing opening 338. For example, the flexible conduit 332 may be attached by the attitude plug 326 to the adapter body 311 at one end. The other end may be held in place by a tube end 334 and ferrule 340. As shown, the tube end 334 includes an obstruction 336, such as a ball bearing that is press fit within an opening of the tube end 334. As shown in FIG. 6, the tube end 334 is inserted within an opening 344 defined in the ferrule 340.

To facilitate placement of the flexible conduit 332 within the structural conduit 302, the external surface of the fluid tube 350 may define a groove 362 for receiving at least a portion of a length of the flexible conduit 332. In one embodiment, the groove 362 is helically disposed about the fluid tube. The groove 362 is effective to prevent kinking or movement of the flexible conduit 332 that may otherwise cause a functional or structural failure of the flexible conduit 332. The flexible conduit might be attached within the groove with an adhesive, snapped in the groove, or otherwise positioned with respect thereto. As shown in FIGS. 7—11, the groove may have a generally helical shape. The expanded central portion is provided for manufacturing purposes.

Figure 18:
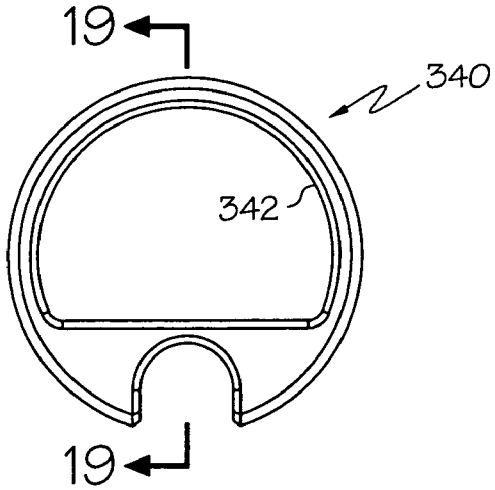
FIG. 18 is a front view of an exemplary ferrule.
Figure 19:
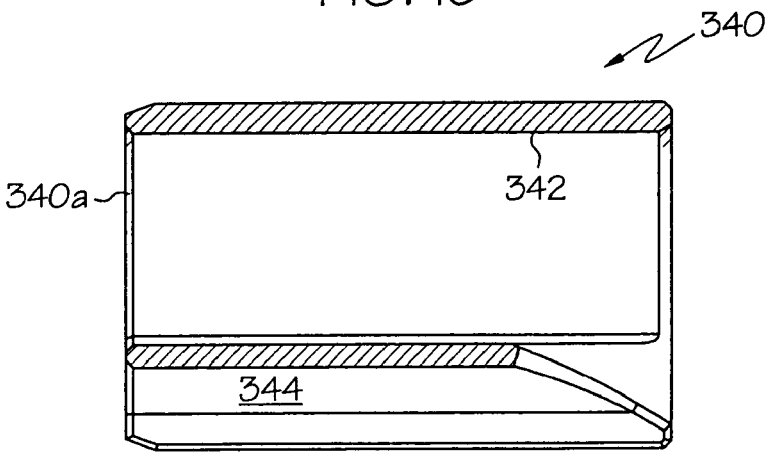
FIG. 19 is a sectional view along line 19—19 of FIG. 18.
Figure 20:
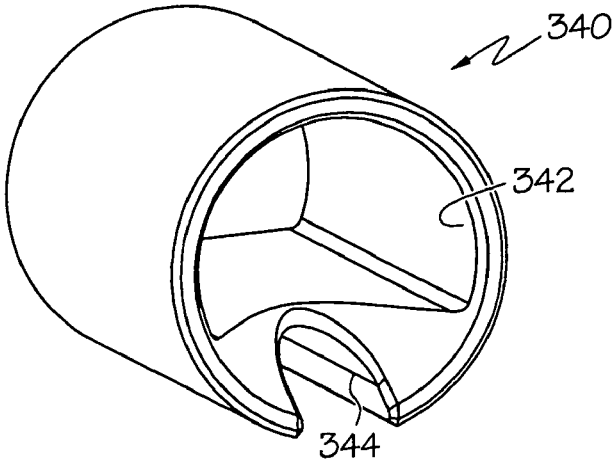
FIG. 20 is a perspective view of the ferrule of FIG. 18.

An exemplary ferrule 340 that can be used with each of the embodiments of the inventions described through the application is illustrated in FIGS. 18—20. The ferrule may include a D-shaped opening 342 to accommodate the D-shaped end 354*a* of the fluid tube (see FIG. 10) while providing room for the tube end opening 344. The ferrule is effective to strengthen the spout end and protect the end of the fuel tube while holding the tube end 334 in position to permit communication between the flexible conduit 332 and the sensing opening 338. The end 340*a* of the ferrule may have a chamfer to allow the end of the structural conduit to be crimped over as shown by reference number 307 in FIGS. 6 and 7.

The components of the nozzle assembly may be selected from various known materials. For example, the tube end 334 and/or the ferrule 340 might be formed from a dye cast zinc or powdered metal stainless steel. The structural conduit 302 and pressure activated control valve pieces may be constructed from aluminum, brass and/or stainless steel. The adapter body portion 311, adapter plug 326, flexible conduit 332 and fluid tube 350 can be formed from Nylon 12 material or acetal resin components such as DELRIN material from E.I. Du Pont De Nemours and Company Corporation.

FIGS. 22—30 illustrate an alternative nozzle 410 in accordance with concepts of the present invention. Nozzle 410, unless otherwise noted, includes many components that are identical or substantially similar to the components described with respect to the nozzle 10 described above. Accordingly, the description of components of the embodiment illustrated in FIGS. 1—21 may be incorporated into the embodiment illustrated in FIGS. 22—30 unless otherwise noted.

The nozzle 410 includes a nozzle body 410 having an inlet 414 for receiving liquid and an outlet 416 for dispensing liquid. The nozzle body 412 further includes a liquid passage 418 extending between the inlet and the outlet. As described with reference to embodiments above, a valve assembly 20 is also adapted to selectively control the flow of liquid through the liquid passage and a lever 250 is pivotally attached to a latch stem at a pivot location 510 that may be identical to the pivot location 110 described above.

Figure 23:
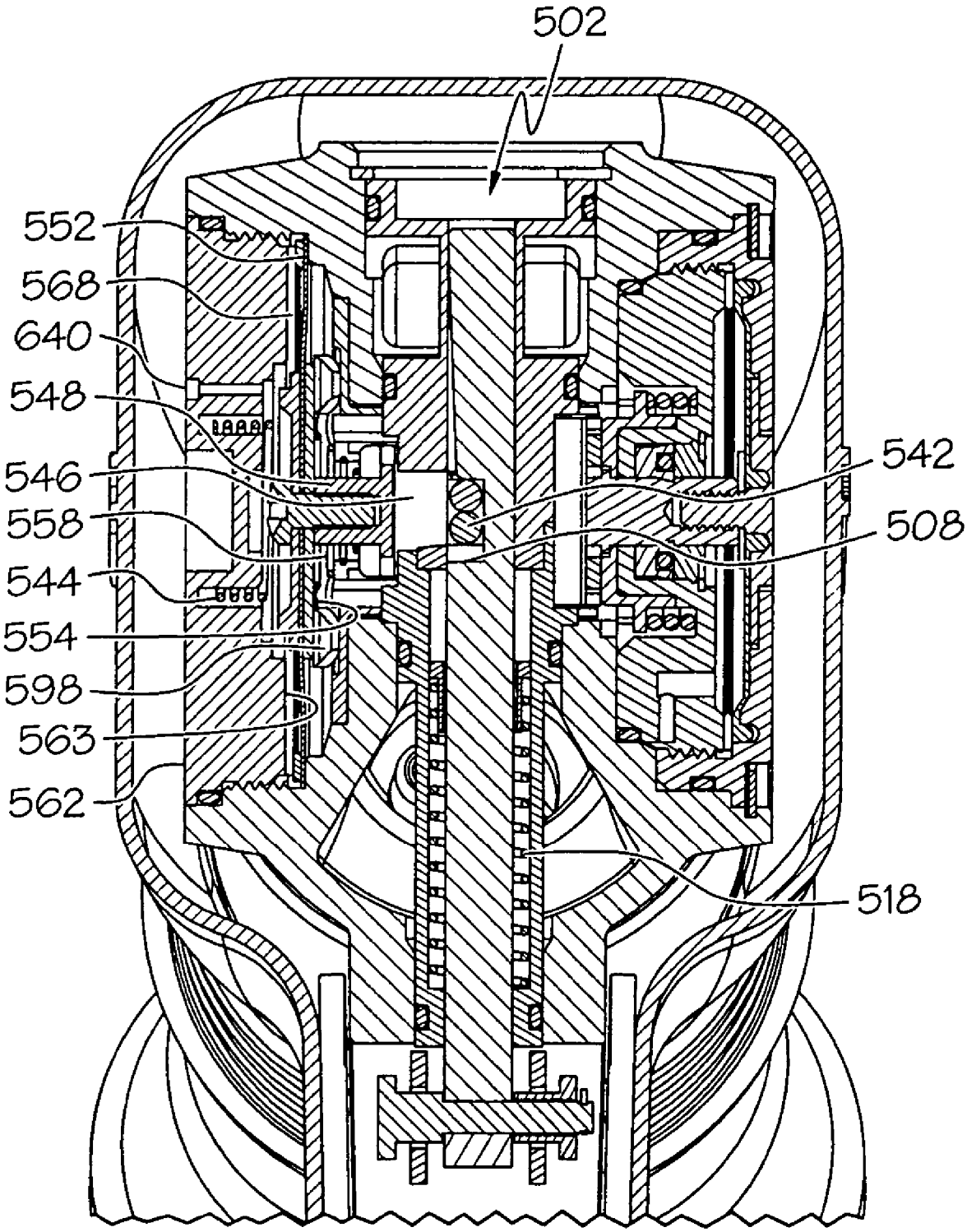
FIG. 23 is a sectional view along line 23—23 of FIG. 22, depicting aspects of the latch stem assembly, latch apparatus and lock-out arrangement, wherein a latch member is arranged in a locked position with respect to a latch stem to provide an operable pivot.
Figure 24:
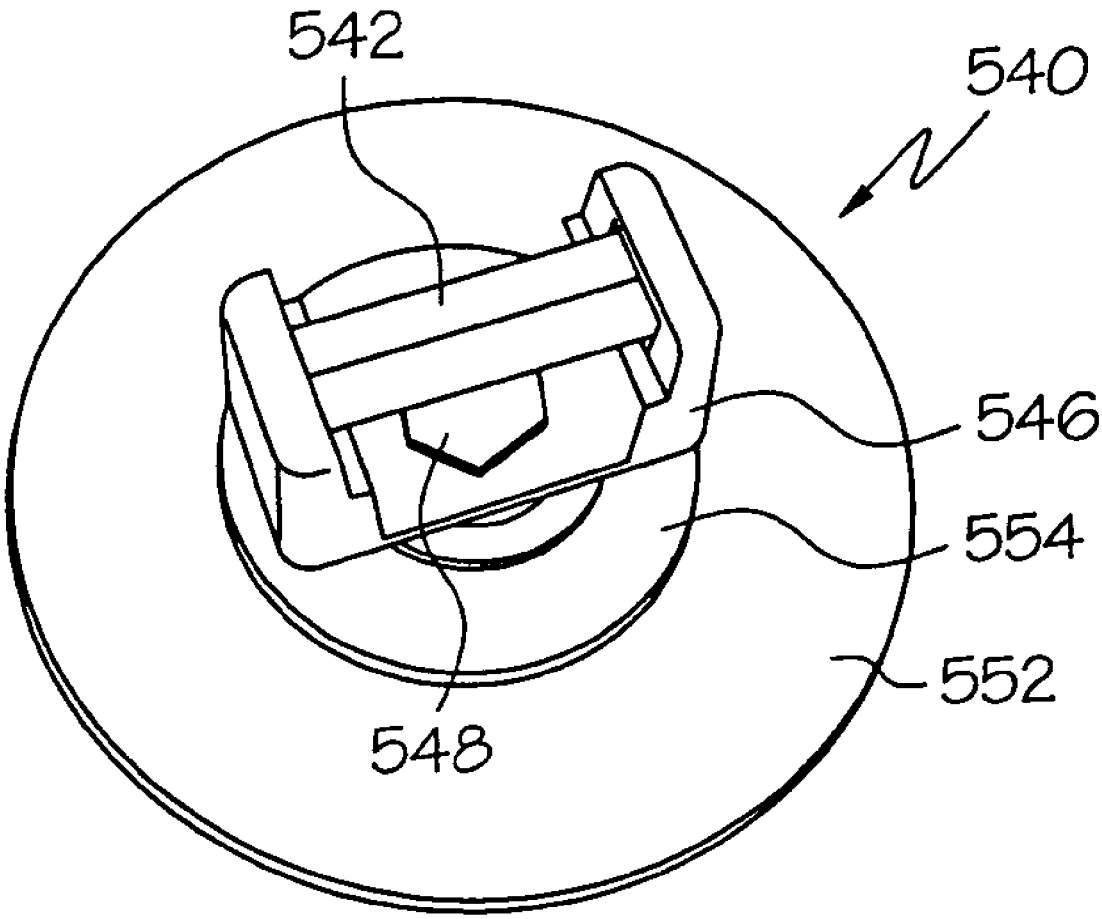
FIG. 24 is a perspective view of a latch apparatus.

The nozzle 410 includes a latch stem assembly 500 with a latch stem 502 and biasing member 518 that function similarly to the latch stem assembly 100 described above. The nozzle 410 further includes a latch apparatus 540 similar to the latch apparatus 140 described above. As shown in FIGS. 23—24, the latch apparatus 540 includes a latch member 542 rotatably mounted to a carrier 546 that in turn is mounted to a spacer 548 for slidable reciprocation relative to a diaphragm 552. A biasing member 558 applies a force to the carrier to urge the carrier away from the diaphragm 552. The biasing member 558 further abuts against a first washer 554. Assembly of the components can be similar to the assembly procedure described with respect to the latch apparatus 140 above.

A vacuum chamber 568 is formed between the diaphragm 552 and an opposed rigid wall 563 of a vacuum cap 562. A diagnostics port 640 may optionally be provided for testing as described more fully below. If provided, the diagnostics port may be obstructed, for example with a valve to prevent loss of fluid through the pressure chamber in use. Once assembled, a biasing member 544 presses against a second washer to bias the diaphragm 552 out toward the latch stem 102 and therefore urges the latch member 542 at least partially into a latch groove 508.

Figure 26:
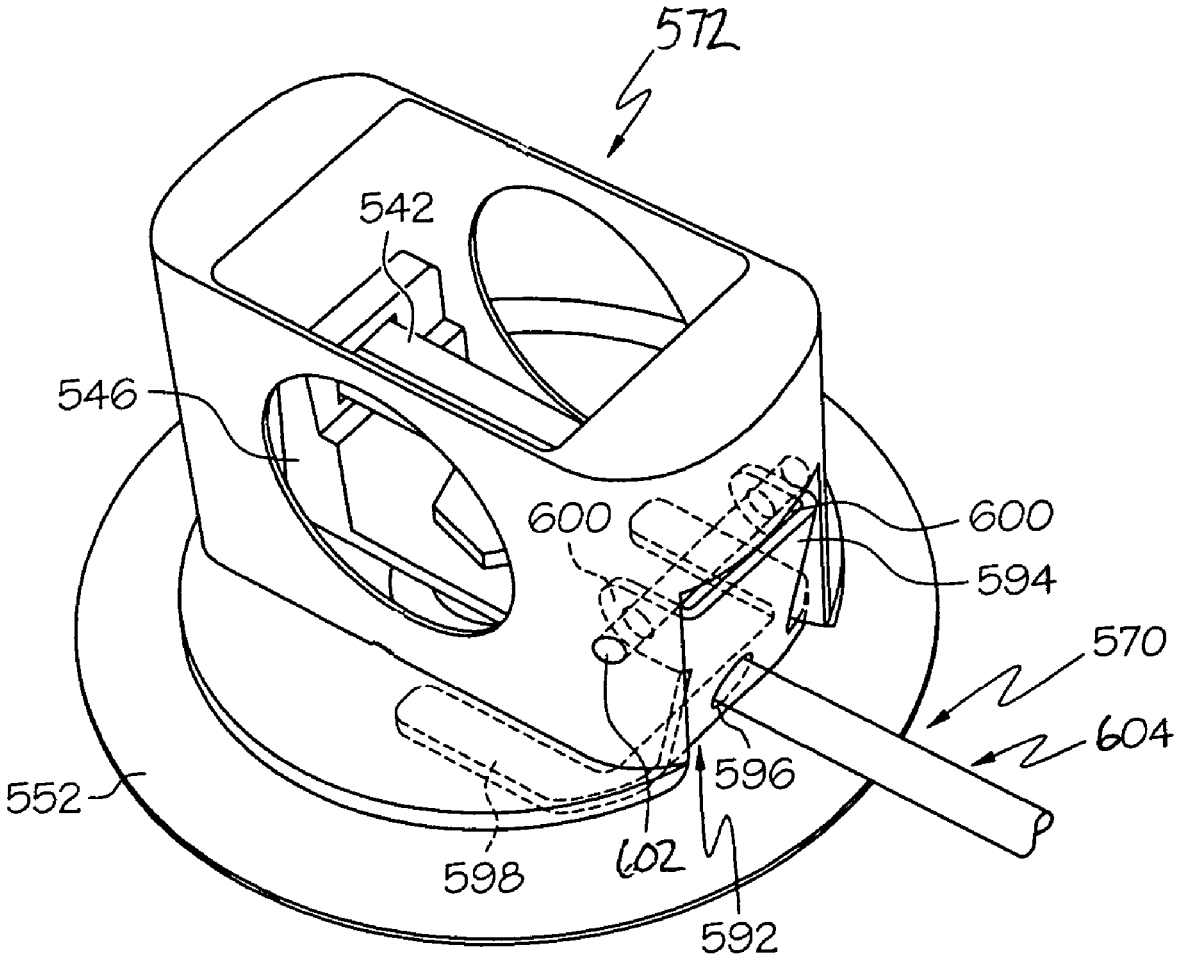
FIG. 26 is a perspective view of a latch apparatus arranged with respect to a guide member.
Figure 27:
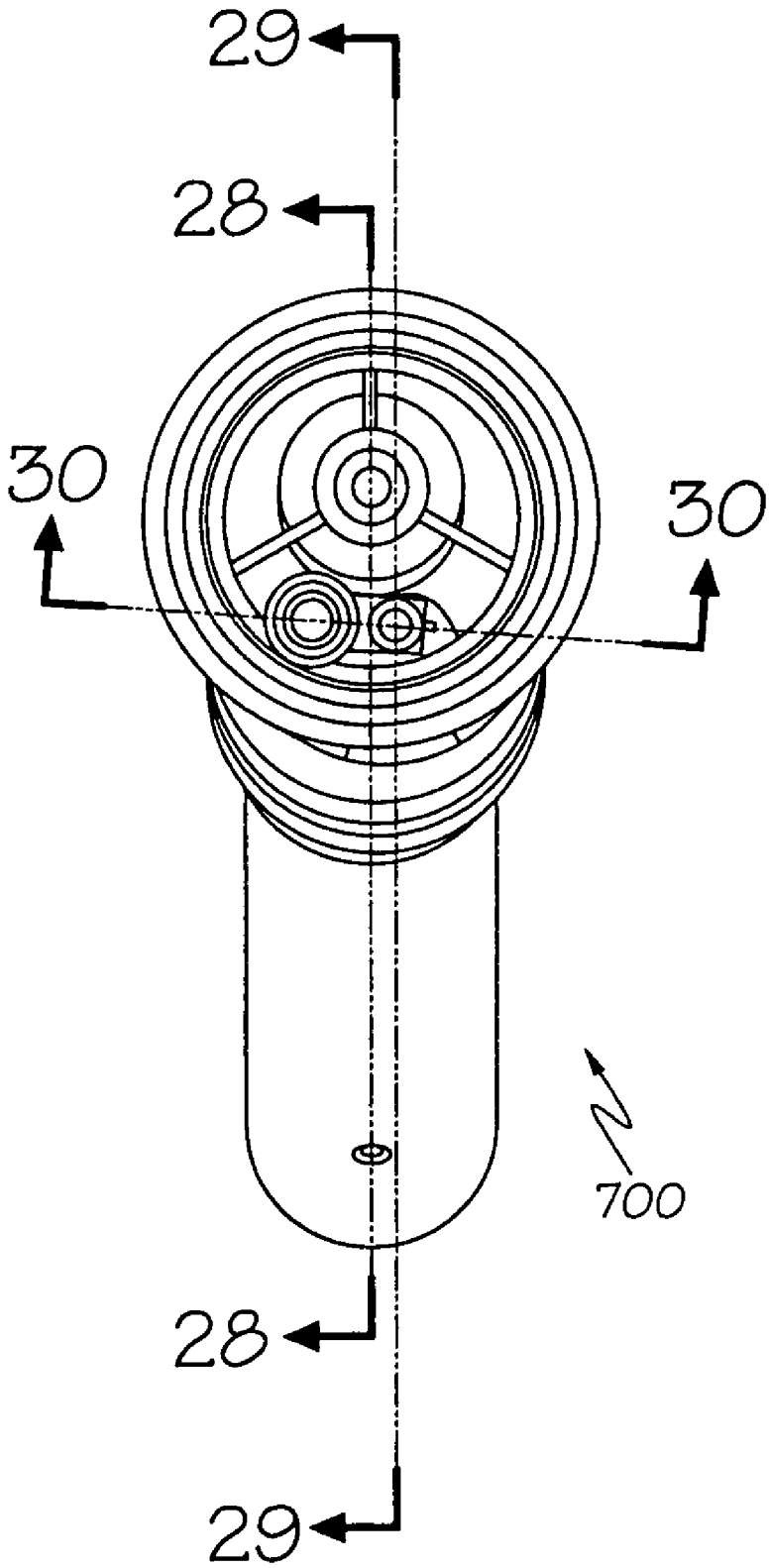
FIG. 27 is an end view of a nozzle assembly in accordance with another aspect of the present invention.

A different lock-out arrangement 570 is used and interacts with the latch apparatus 540 in a manner that is different than the nozzle assembly 10 described above. Indeed, the lock-out arrangement 570 includes a puller that acts to pull the latch member 542 out of the latch groove 508 when sufficient tension exists in a sensor 604. As shown in FIG. 26, the lock-out arrangement 570 puller comprises a link 592 pivotally connected to a guide member 572. In particular, a pivot pin 602 may extend through the guide member 572 and pivot tabs 600 to pivotably connect the link 592 to the guide member 572. As with the link 192, the link 592 includes a base portion 594 with an engagement arm 598 extending therefrom. The base portion 594 further includes an aperture 596 adapted for the sensor 604 to be threaded therethrough. Once the puller is installed, as shown in FIG. 23, the engagement arm 598 of the link 592 presses against the first washer 554. Thus, tension within the sensor 604 causes the engagement arms 598 to press up against the first washer 554, against the force of the biasing member 544.

Figure 25:
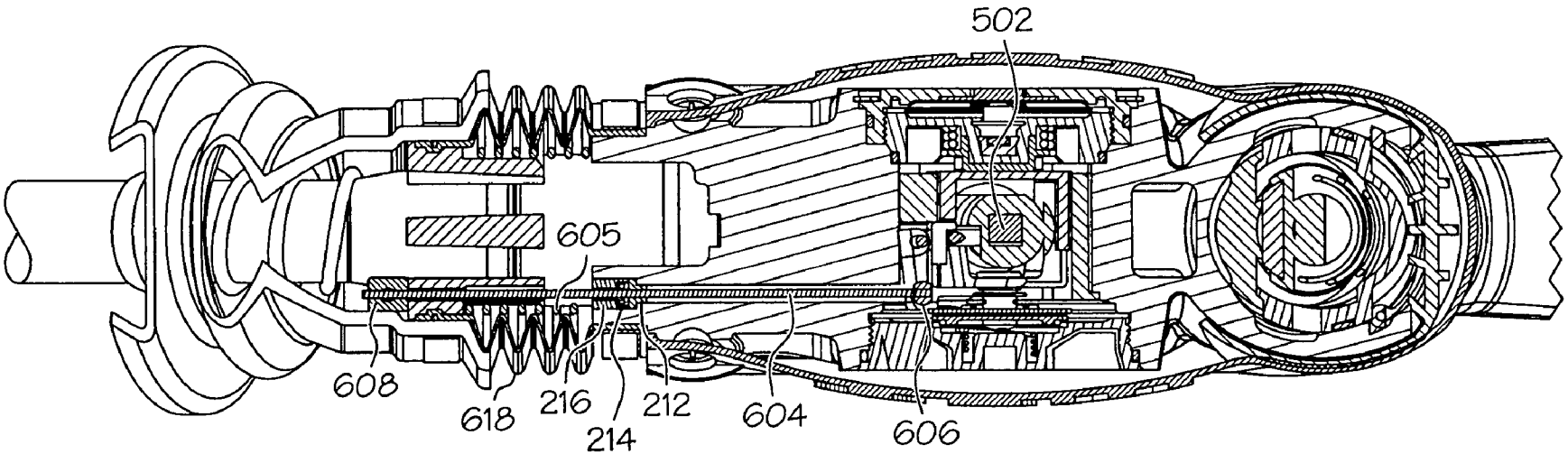
FIG. 25 is a sectional view along line 25—25 of FIG. 22.

The sensor 604 is similar to the sensor 204 described above. For example, as shown in FIG. 25 the sensor 604 is provided with stops, such as one-way stops 606, 608. The sensor 604 can also be provided with a wear resistant structure including a coating of wear resistant material and may also be provided with a bushing through the nozzle body to reduce wear on the sensor. As with the lock-out arrangement 170, the lock-out arrangement 570 includes a biasing member 605 adapted to place the sensor 604 in tension when the nozzle is not properly inserted with respect to the container.

In operation, when the nozzle 412 is properly inserted with respect to the container, the shroud 622 circumscribes an opening of the container. Further displacement of the nozzle 412 causes a guide 619 to compress the bellows 618 and biasing member 605 to release tension in the sensor 604. As shown in FIG. 23, once the tension is released in the sensor, the engagement arms 598 cease to provide force against the first washer 554. The biasing member 544 is then free to push the latch member 542 at least partially into the latch groove 508 by pressing against the second washer. Accordingly, with the latch member 542 at least partially inserted into the latch groove 508, the latch stem 502 is locked with respect to the nozzle body 412 to provide an operable pivot for the lever 250.

The latch stem 502 may then be unlocked by removal of the nozzle from the container or by an underpressure event occurring in the vacuum chamber 568. If the nozzle is removed from the container, the biasing member 605 presses against the guide 619 to cause tension within the sensor 602. Stop 606 then pulls against the base portion 594 of the link to pivot the link 592 with respect to the guide member 572. The pivoting movement causes the engagement arm 598 to press against the first washer 554 to counter the force of the biasing member 544 and thereby flex portions of the diaphragm such that a central area of the diaphragm 552 moves toward the rigid wall 563 of the vacuum cap 562. As the central portion of the diaphragm 552 moves toward the rigid wall 563, the latch member 542 is pulled at least partially out of the latch groove 508. Therefore, tension in the sensor 604 is adapted to unlock the latch stem 502 by using a puller (e.g., the link 592) to pull the latch member 542 at least partially out of the latch groove 508. In contrast, as discussed with respect to the nozzle 10 above, the sensor 204 is adapted to unlock the latch stem 102 by using a pusher 181 (e.g., link 192 and engagement member 182) to push the latch member 142 at least partially out of the latch groove 108.

As with the nozzle 10 discussed with previous embodiments, the nozzle 410 is also adapted to cause unlocking of the latch stem 502 with respect to the nozzle body 412 when a sufficient underpressure condition exists in the vacuum chamber 568. During an underpressure condition, the central portion of the diaphragm will move toward the rigid wall 563, against the force of the biasing member 544 to pull the latch member 542 at least partially out of the latch groove 508 to release the latch stem 502.

It is noted that an optional pressure mechanism may be provided as shown on the right side of the latch stem 508 appearing in FIG. 23. The pressure mechanism requires pressure within the fluid chamber to inflate the pressure chamber, thereafter causing a diaphragm to flex to the right as shown in FIG. 23. As shown, the pressurized chamber causes the diaphragm to flex such that an engagement member is pulled away, against the force of a spring, to disengage the carrier 546, thereby allowing the latch member 542 to be forced by the biasing member 544 at least partially into the latch groove 508 to lock the latch stem 502 with respect to the nozzle body 412.

Figure 28:
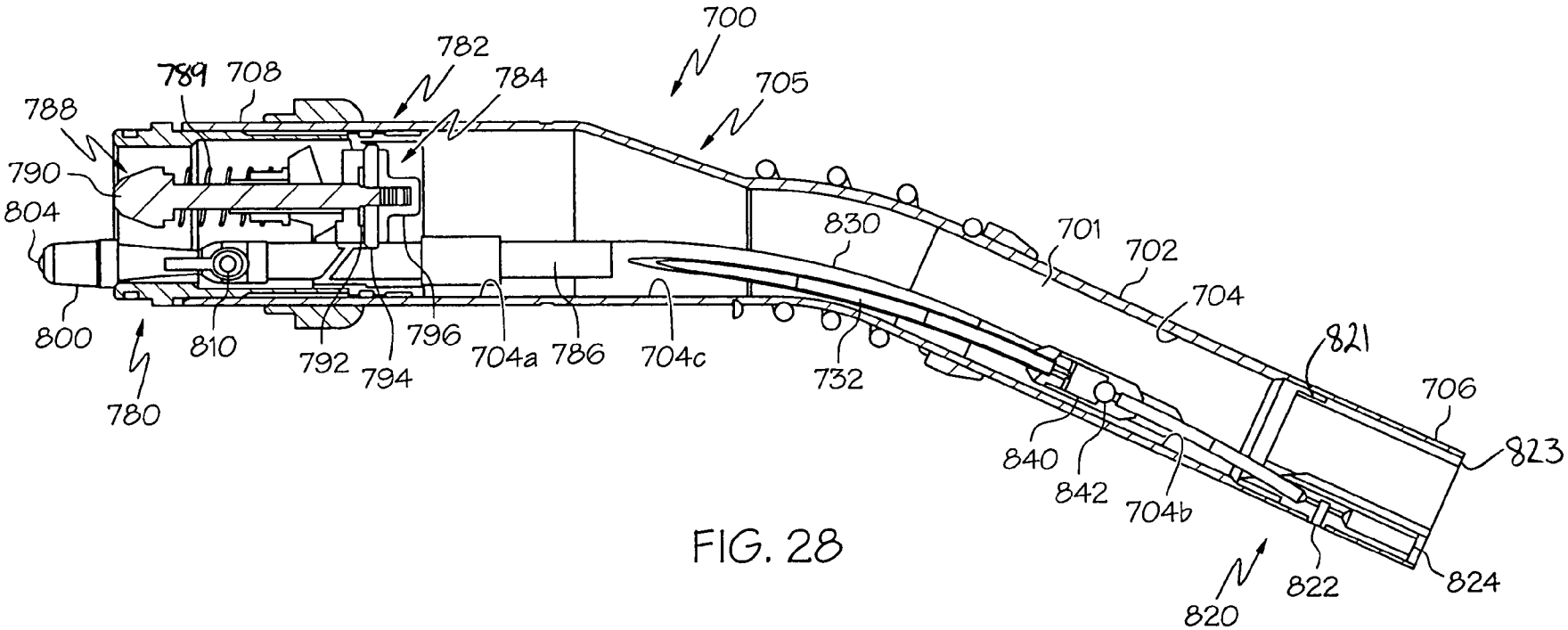
FIG. 28 is a sectional view of the nozzle assembly along line 28—28 of FIG. 27.
Figure 29:
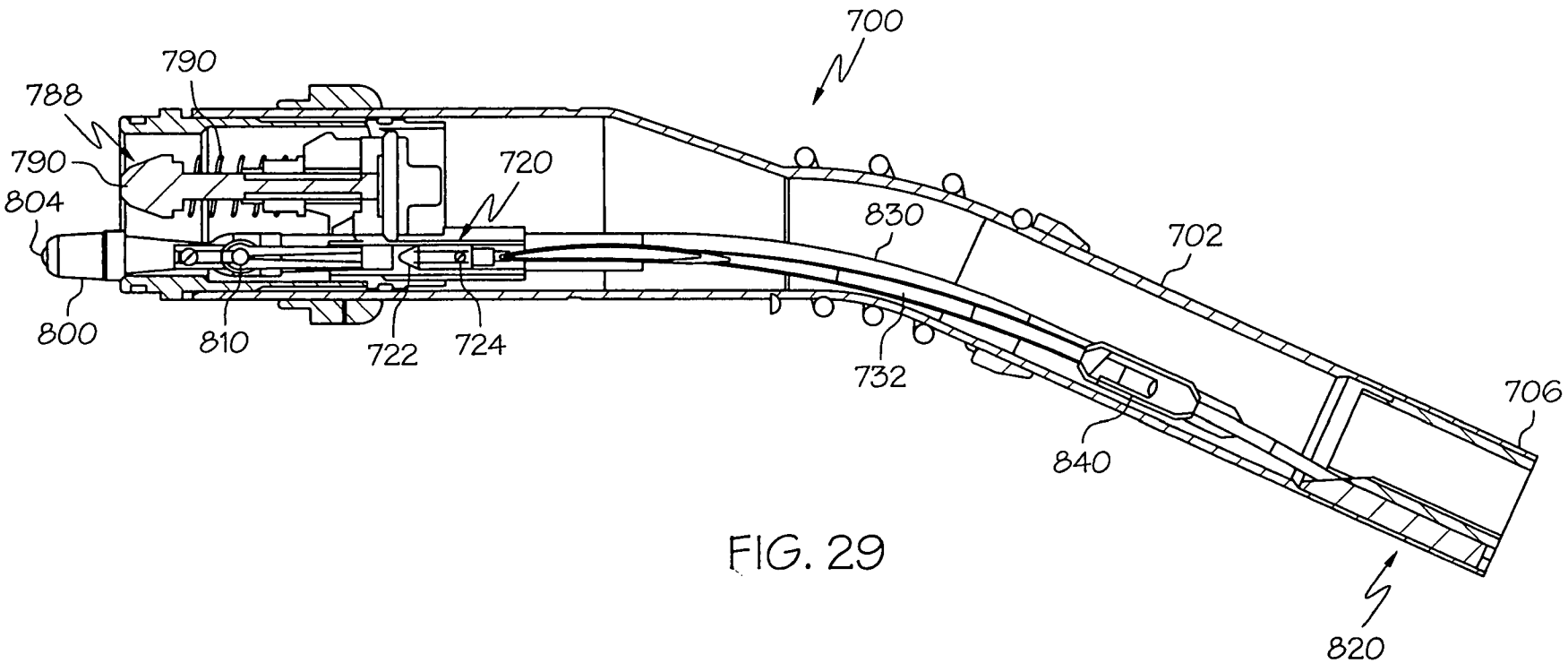
FIG. 29 is a sectional view of the nozzle assembly along line 29—29 of FIG. 27.
Figure 30:
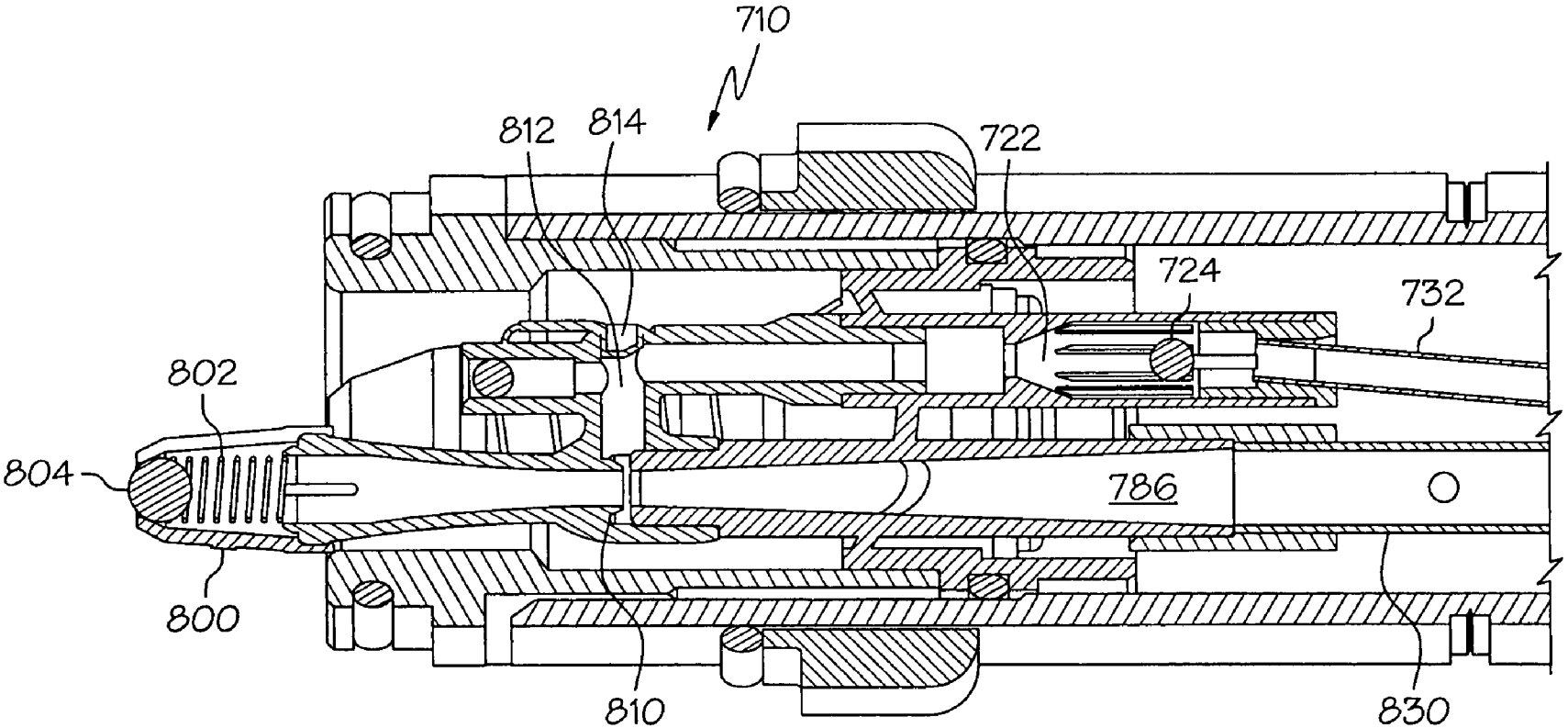
FIG. 30 is a sectional view of the nozzle assembly along line 29—29 of FIG. 27.

An additional spout assembly 700 is depicted with reference to FIGS. 28—30. As evident, features of the nozzle assembly 300 are also found in nozzle assembly 700 and therefore further explanation is not necessary. For instance, nozzle assembly 700 includes a structural conduit 702 that has similar internal sidewall portions as discussed with respect to the internal sidewall portions reference with spout assembly 300 above. As shown, the structural conduit 702 includes a first end portion 708 for attaching relative to a nozzle body and a second end portion 706 for dispensing liquid. An interior passage 701 provides an internal flow path from the first end portion 708 to the second end portion 706. The structural conduit 702 includes an internal sidewall 704 with a first sidewall portion 704*a*, a second sidewall portion 704*b*. The structural conduit 702 further includes a transition location 705 comprising a third sidewall portion 704*c*. As with the structural conduit 302, the internal sidewall 704 of structural conduit 702 is adapted to substantially prevent pooling of liquid being dispensed from the nozzle.

Spout assembly 700, according to one embodiment of the present invention, includes an adapter 780 with a dual path liquid control valve 782 at the first end portion 708 of the structural conduit 702. Placement of the dual path liquid control valve 782 upstream within the structural conduit 702 may allow the fluid to exit the second end portion 706 in a more developed flow pattern and may tend to prevent turbulence, and problems associated therewith, in the fluid discharge.

The dual path liquid control valve 782 includes both a primary liquid path 784 and an auxiliary liquid path 786. The auxiliary liquid path 786 has a cross-sectional flow area that is smaller than the cross-sectional flow area of the primary liquid path 784. The dual path liquid control valve 782 also includes a first pressure activated valve 788 disposed in the primary liquid path 784, which includes a biasing member 789, such as a spring, to urge the valve 788 to a closed position. As best seen in FIGS. 28 and 29, the specifically illustrated embodiment includes a hub that is centrally disposed in the primary liquid path 784, which hub is supported by a plurality of uniformly spaced radially inwardly extending supports (only two of which are shown in FIGS. 28 and 29). The hub slidably supports a valve stem 790. The valve stem 790 has a bulbous portion on one end and a valve closure member at its opposite end. A valve retainer 796 holds a valve seal 794 with respect to the valve stem 790. A helical compression spring 789 surrounds the valve stem 790 between the bulbous portion and the hub to resiliently bias the valve seal 794 against a valve seat 792 to bias the valve to a closed position. The spring 789 is selected to provide a resistance force sufficient to urge the valve to a closed position, but sufficiently low so that pressurized fluid from a pump will overcome the spring force of the compressing spring 789 to release the valve seal 794 from the valve seat 792, thereby orienting the first pressure activated valve 788 to an open position.

The dual path liquid control valve 782 further includes a second pressure activated valve 800 disposed in the auxiliary liquid path 786. Auxiliary liquid path 786 is closable on one side by a ball-like closing body 804, which is biased counter to the flow direction by a biasing member 802, such as spring, which urges the second pressure activated valve 800 to a closed position.

Each of the first and second pressure activated valves may be openable in response to fluid pressure from fluid flow from the output of the nozzle body. The biasing members, such as springs 789 and 802, of the pressure activated valves, 788 and 800, may be adjusted so that the second pressure activated valve 800 may be openable in response to a lower fluid pressure than that required to open the first pressure activated valve 788. Therefore, the auxiliary liquid path 786, controlled by the second pressure activated valve 800, may open before the opening of the primary liquid path 784, which is controlled by the first pressure activated valve 788. The pressure at which the auxiliary liquid path 786 will open may be adjusted using the biasing force such that a full fluid receptacle can be detected timely, i.e. before the primary liquid path 784 opens and the fluid receptacle overflows.

As the biasing force may be adjusted such that the second pressure activated valve 800 opens prior to the opening of the first pressure activated valve 788, the biasing force may similarly be adjusted such that fluid may flow through the auxiliary flow path 786 before the opening of the first pressure activated valve 788. In a more specific embodiment of the present invention, the bias is chosen such that the auxiliary flow path 786 is opened at a fluid pressure of preferably 150–200 millibar. When the fluid pressure upstream of the first pressure activated valve 788 is sufficiently high, in a specific embodiment 250–300 millibar, valve 788 will move to the open position and fluid will flow through primary liquid path 784.

The spout assembly 700 may further comprise a venturi 810, located downstream of the second pressure activated valve 800 within in the auxiliary liquid path 786. Venturi 810 may be in fluid communication with each of a liquid sensing location 820 and a shut-off mechanism as will be described below. Therefore, venturi 810 may be operative to activate the shut-off mechanism in response to one of multiple predetermined conditions, again, as will be discussed below. Fluid flow through venturi 810 results in an increased underpressure within restriction 814, which is detectable, and, with cooperation of the nozzle shut-off mechanism, the underpressure causes the closure of the valve assembly 20 of the dispensing nozzles. Consequently, the fluid pressure between the first end portion 708 and the dual fluid control valve 782 diminishes such that the first and second pressure activated valves, 788 and 800, close and such that flow through the primary flow path 784 and the auxiliary flow path 786 ceases.

In a more specific embodiment of the present invention, a spout assembly 700 having a dual path fluid control valve 782, as discussed above, further includes an exhaust conduit 830 for discharging the auxiliary flow substantially at the second end portion 706 of the structural conduit 702. As previously discussed, the auxiliary flow path opens sooner than the primary flow path, as less pressure is required to open the second pressure activated valve 800. Consequently, this path will also close subsequent to the closure of the primary flow path. Therefore, it is desirable to have the fluid passing through the auxiliary flow path and to the venturi to exit the spout as rapidly as possible, so as to reduce or eliminate leakage or drippage after fluid delivery has been halted. This exhaust conduit 830 contributes to achieve this goal, as the exhaust conduit 830 directs flow that has passes through the venturi 810 proximate to the second end portion 706. As a result, the fluid is not required to pass over the larger interior sidewall 704 of the structural conduit 702, which would consequently lead to longer evacuation times for the dispensing liquid and consequently to increased leakage or drippage from the spout assembly.

According to another embodiment of the present invention, various components within the spout are formed of a synthetic acetal resin. One commercially available acetal resin that Applicants have used successfully is sold by E. I. Du Pont De Nemours and Company Corporation under the trademark Delrin™. These materials have not been used within spouts in the past, as these materials are typically machined and the areas within the spout are typically too small to accommodate machined parts. These materials provide an advantage over Nylon 6, however, in that they are less likely to swell with increased exposure to fluids, particularly liquid. Consequently, the spout components are less likely to deform and leakage or drippage may be reduced or eliminated. According to the present invention, however, the acetal resin components may be joined to one another through use of adhesives, including cyanoacrylate adhesives, such as those sold commercially by Henkel Loctite Corporation.

The nozzle in accordance with the embodiments of the present invention may include a mechanism for unlocking the latch stem from the nozzle body. With one optional aspect of the invention, a vacuum actuated mechanism is provided to disengage the latch member from the latch groove of the latch stem in response to liquid in the fill pipe that exceeds a given level, sensed at a fluid level sensing location. According to another optional aspect of the invention, unlatching of the latch stem may occur, for example, when the nozzle is lifted up and away from the ground. According to yet another optional aspect of the invention, the latch stem is unlocked when pressure is applied, as for example through a pre-pay mechanism.

As previously indicated, an underpressure condition within the vacuum chambers herein may unlock the latch stem from the nozzle body in response to detection of a level of liquid in the fill pipe in the area surrounding the second end portion of the structural conduit. Fluid dispensing nozzles 300 and 700 include examples of a vacuum control mechanism that is operable to discontinue fluid flow through the nozzle when fluid is detected proximate a fluid level sensing location. As shown in FIGS. 28 and 29, the vacuum control mechanism may take the form of a fluid conduit 732, adapted for disposition in the structural conduit 702. The fluid conduit 732 includes a liquid-sensing segment 820 and a nozzle shut-off control segment 710 (see FIG. 30). Similarly, with respect to FIG. 6, the conduit 332 includes a fluid sensing segment near sensing opening 338 and a nozzle shut-off control segment near 326.

The fluid-sensing segments are adapted to be positioned in a fluid level sensing location, for example, within a fluid receptacle, such as a liquid fill tank. Once the liquid level within the fluid receptacle reaches the fluid level sensing location, liquid will be drawn into the fluid conduit 332, 732. The shut-off control segments of the fluid conduits is adapted to communicate with the corresponding vacuum chambers to effect a nozzle shut-off by creating a vacuum condition in the vacuum chamber.

When the nozzle is operative, fluid conduits are subject to underpressure. In one embodiment of the present invention, this underpressure may be created by a venturi, positioned downstream of a manually activated valve.

As shown in FIGS. 28—30, for example, as fluid passes through the venturi 810, underpressure is created within channel 812, which (although partially obscured in FIG. 30) is connected to fluid conduit in communication with the vacuum chamber 568. When a fluid sensing location, for example a fluid fill tank or other fluid receptacle, becomes covered with liquid, liquid as well as air will enter openings 822 and 824 of the fluid sensing segment 820 and continue through fluid conduit 732 until fluid conduit 732 is closed and the underpressure ceases.

As shown in FIG. 30, a closing body 724 may be received in the fluid conduit 732 for closing the fluid conduit 732 when fluid is detected. The closing body 724 is preferably adapted to be carried along by fluid flow to an upstream position in which the closing body 724 is received into a closing plug 722 to substantially close the fluid conduit 732. In a more specific embodiment, as depicted in FIG. 30, the closing body 724 has a spherical configuration. The fluid is carried up the fluid conduit 732 by the underpressure created by venturi 810, which in FIG. 30 is created when fluid flows through an auxiliary flow path 786 to venturi 810. This closing body 724 must be carried by the fluid to a position in which it closes the fluid conduit 734; fluid alone may be insufficient to close the fluid conduit 734.

The closure of fluid conduit 734 results in an abrupt pressure difference and an increased underpressure within restriction 814 (see FIG. 30), which may be detected in a simple manner, and effectuates nozzle shut-off. As a result of the increased underpressure experienced in vacuum chamber 568 and the latch stem is released.

The valve assembly 20 will also close if the spout of the fluid dispensing nozzle is moved substantially upwardly from a generally horizontal dispensing orientation. When the fluid dispensing nozzle is in such an upward position, closing body 724, in response to gravity, rolls to the position in which it closes the fluid conduit 734. In a manner similar to that previously discussed underpressure within the vacuum chamber will unlock the latch stem.

In accordance with exemplary embodiments of the present invention an open-ended cavity 821 may be formed formed proximate to the second end portion 706 of the spout assembly 700, the cavity being at least partially circumferentially disposed about the liquid passage and being operative to capture liquid flowing down the internal sidewall 704 in the direction of the internal liquid flow path toward the second end portion of the spout assembly. For example, as shown, the open-ended cavity 821 is formed at least partially by the internal sidewall 704 and partially by a groove in a ferrule 823. Although not shown, it is possible that the open ended cavity may be formed entirely by the ferrule or by the internal sidewall. As further shown, the open-ended cavity 821 opens in a direction generally opposite to the direction of the internal liquid flow path and also is open in a radially inward direction.

As evident from the above, numerous benefits come from a spout constructed in accordance with the principles of the present invention. For example, the configuration of an internal sidewall 704 of the structural conduit 702 contributes to the reduction or elimination of drippage from the spout assembly 700. When such an asymmetrically tapered spout is in a dispensing position, the flattened surface where of the lower interior fluid flow path provides a more direct fluid flow path to the discharge end of the spout. The fluid flowing within the flow path is not required to overcome gravity in order to surmount a fairly substantial elevation as would be present in a conventional, symmetrically tapered spout. More specifically, this flattened area promotes more efficient flow through of liquid, as the spout assembly does not comprise a pocket-like area on the lower inside surface of the spout, which would allow fluid to there accumulate. Fluid is therefore far less likely to accumulate in this transition section, and any drippage or leakage from the spout after the halting of fluid delivery is reduced or eliminated, as compared to a conventional, symmetrically tapered spout.

Still further each embodiment of the present invention may include a diagnostics port to permit testing of the vacuum chamber to ensure that proper underpressure is maintained. With respect to FIG. 21, diagnostics portion 240 may be provided at an exterior location of the nozzle body 12. The port 240 provides fluid communication with pressure chamber 168. The diagnostics port 240 may be closed, when not in use, by a plug 242 and O-ring 244 combination. Similarly, with respect to FIG. 23, a diagnostics port 640 is illustrated. The diagnostics ports of the present invention may be used in a method for detecting underpressure within a liquid dispensing nozzle. The method may include providing a fuel dispensing nozzle and a vacuum sensing instrument wherein the vacuum sensing instrument is connected with the diagnostics port and a vacuum sensing instrument is inserted to measure the underpressure in the vacuum path. It is understood that such ports may also be installed to test overpressure of certain chambers, such as within a pressurized chamber.

Exemplary embodiments herein disclose an exemplary vacuum control mechanisms for use in a liquid dispensing nozzle. As shown in FIG. 28, the vacuum control mechanism comprises a check valve 840 disposed in the fluid conduit 732, the check valve 840 being operative to allow the flow of liquid through the fluid conduit in a direction from the liquid-sensing segment toward the nozzle shut-off control segment and to substantially prevent the flow of liquid in the direction from the nozzle shut-off control segment to the liquid-sensing segment. In the specific embodiment depicted in FIG. 28, the check valve 840 includes a ball-like closing body 842. Once the fluid within the fluid conduit 732 begins to flow downstream from the closing plug, the closing body 842 will revert back to its downstream position within the check valve 840, thereby blocking and containing any remaining fluid within the fluid conduit upstream of the closing body 842. In exemplary embodiments, the check valve and fluid conduit are formed of a material comprising acetal resin.

The foregoing description of exemplary embodiments and examples of the invention has been presented for purposes of illustration and description. It is not intended to be exhaustive or limit the invention to the forms described. Numerous modifications are possible in light of the above teachings. Some of those modifications have been discussed, and others will be understood by those skilled in the art. The embodiments were chosen and described in order to best illustrate the principles of the invention and various embodiments as are suited to the particular use contemplated. It is hereby intended that the scope of the invention be defined by the claims appended hereto.

What is claimed is:

1. A spout assembly for dispensing liquid from a nozzle, comprising:

a) a structural conduit including:

i) a first end portion for attaching relative to a nozzle body and a second end portion for dispensing liquid;

ii) an interior passage providing an internal flow path from the first end portion to the second end portion; and iii) at least one internal sidewall, the internal sidewall including a first sidewall portion with a first cross-sectional dimension, a second sidewall portion with a second cross-sectional dimension that is smaller than the first cross-sectional dimension, and a transition location between the first and second sidewall portions, wherein the transition location provides for the change in cross-sectional dimensions between the first sidewall portion and the second sidewall portion, the first sidewall portion includes a length at least partially defining a First portion of a substantially straight liquid flow path, wherein the first portion of the substantially straight liquid flow path extends through the transition location without the transition location changing the first portion of the substantially straight liquid flow path and the second sidewall portion includes a length at least partially defining a second portion of the substantially straight liquid flow path, wherein the second portion of the substantially second straight liquid flow path extends through the transition location wherein the transition location changes the second portion of the substantially straight liquid flow path.

2. The spout assembly of claim 1, wherein the first and second sidewall portions each have a substantially circular cross-sectional shape wherein the first and second cross-sectional dimensions comprise respective diameters of the first and second sidewall portions.

3. The spout assembly of claim 1, wherein the transition location comprises a third sidewall portion of the internal sidewall that further defines the substantially straight liquid flow path.

4. The spout assembly of claim 3, wherein the first and third sidewall portions each have a substantially circular cross-sectional shape.

5. The spout assembly of claim 4, wherein the substantially circular cross-sectional shape of the first sidewall portion defines a diameter and wherein successive cross sections of the third sidewall portion along the substantially straight liquid flow path define a plurality of substantially circular cross-sectional shapes defining a plurality of successively smaller diameters.

6. The spout assembly of claim 5, wherein a lower portion of each of the cross-sectional shapes of the first and third sidewall portions at least partially define the substantially straight liquid flow path.

7. The spout assembly of claim 1, wherein the second sidewall portion of the interior sidewall includes a substantially straight portion and an angular portion, wherein the angular portion provides an angular orientation between the first sidewall portion and the substantially straight portion of the second sidewall portion.

8. The spout assembly of claim 1, further comprising a spout adapter mounted with respect to the first end portion of the structural conduit, the spout adapter including a pressure activated control valve adapted to permit flow of the liquid into the spout assembly from a nozzle at a predetermined liquid pressure.

9. The spout assembly of claim 8, wherein the spout adapter further includes at least one adapter internal sidewall including a first adapter sidewall portion with a first adapter cross-sectional dimension adapted to receive a portion of the pressure activated control valve, a second adapter sidewall portion with a second adapter cross-sectional dimension that is smaller than the first adapter cross-sectional dimension, and an adapter transition location between the first and second adapter sidewall portions, wherein the adapter transition location provides for the change in cross-sectional dimensions between the first adapter sidewall portion and the second adapter sidewall portion, the first adapter sidewall portion includes a length at least partially defining a substantially straight adapter liquid flow path, wherein the substantially straight adapter liquid flow path extends through the adapter transition location without the adapter transition location changing the first portion of the substantially straight liquid flow path.

10. The spout assembly of claim 9, further comprising a fluid tube disposed in the interior passage of the structural conduit and in fluid communication with the pressure activated control valve, wherein the second adapter cross-sectional dimension is adapted to receive a first end portion of the fluid tube, and wherein a second end portion of the fluid tube is adapted to dispense the liquid adjacent the second end portion of the structural conduit.

11. A spout assembly for dispensing liquid from a nozzle, comprising:

a) a structural conduit including:

i) a first end portion for attaching relative to a nozzle body and a second end portion for dispensing liquid;

ii) an interior passage providing an internal flow path from the first end portion to the second end portion; and iii) at least one internal sidewall, the internal sidewall including a first sidewall portion with a first cross-sectional dimension, a second sidewall portion with a second cross-sectional dimension that is smaller than the first cross-sectional dimension, and a transition location between the first and second sidewall portions, wherein the transition location provides for the change in cross-sectional dimensions between the first sidewall portion and the second sidewall portion, the first sidewall portion includes a length at least partially defining a substantially straight liquid flow path, wherein the substantially straight liquid flow path extends through the transition location without the transition location changing the substantially straight liquid flow path; and b) a spout adapter mounted with respect to the first end portion of the structural conduit, the spout adapter including a pressure activated control valve adapted to permit flow of the liquid into the spout assembly from a nozzle at a predetermined liquid pressure, wherein the spout adapter further comprises a venturi channel and an attitude device in fluid communication with the venturi channel, wherein the attitude device comprises a closing body adapted to close an opening of the venturi channel upon tilting of the spout assembly beyond a predetermined angle.

12. The spout assembly of claim 11, wherein the attitude device further comprises a bridge to trap the closing body in an interior area of the spout adapter.

13. The spout assembly of claim 12, wherein the bridge includes an aperture adapted to facilitate a pressure differential to bias the closing body against the bridge unless the spout assembly is tilted beyond a predetermined angle.

14. The spout assembly of claim 11, wherein the spout adapter further includes at least one adapter internal sidewall including a first adapter sidewall portion with a first adapter cross-sectional dimension adapted to receive a portion of the pressure activated control valve, a second adapter sidewall portion with a second adapter cross-sectional dimension that is smaller than the first adapter cross-sectional dimension, and an adapter location between the first and second adapter sidewall portions, wherein the adapter transition location provides for the change in cross-sectional dimensions between the first adapter sidewall portion and the second adapter sidewall portion, the first adapter sidewall portion includes a length at least partially defining a substantially straight adapter liquid flow path, wherein the substantially straight adapter liquid flow path extends through the adapter transition location without the adapter transition location changing the first portion of the substantially straight liquid flow path.

15. A spout assembly for dispensing liquid from a nozzle, comprising:

a) a structural conduit including:

i) a first end portion for attaching relative to a nozzle body and a second end portion for dispensing liquid;

ii) an interior passage providing an internal flow path from the first end portion to the second end portion; and iii) at least one internal sidewall, the internal sidewall including a first sidewall portion with a first cross-sectional dimension, a second sidewall portion with a second cross-sectional dimension that is smaller than the first cross-sectional dimension, and a transition location between the first and second sidewall portions, wherein the transition location provides an asymmetric change in cross-sectional dimensions between the first sidewall portion and the second sidewall portion, wherein the internal sidewall substantially prevents pooling of the liquid being dispensed from the nozzle.

16. The spout assembly of claim 15, wherein the first sidewall portion includes a length that at least partially defines a substantially straight liquid flow path, wherein the substantially straight liquid flow path extends through the transition location without the transition location changing the substantially straight liquid flow path.

17. The spout assembly of claim 15, wherein the first sidewall portion includes a length that at least partially defines a first substantially straight liquid flow path, the second sidewall portion includes a length that at least partially defines a second substantially straight liquid flow path that is oriented at an obtuse interior angle with respect to the first substantially straight liquid flow path.

18. The spout assembly of claim 17, wherein a curved portion of the interior sidewall provides the transition between the substantially straight liquid flow paths of the first and second sidewall portions.

19. The spout assembly of claim 18, wherein a corresponding imaginary tangential line extends through each point along the curved portion, each imaginary tangential line extending at an interior angle with respect to the substantially straight liquid flow path of the first portion in the range from about 1800 to about the obtuse internal angle.

20. The spout assembly of claim 15, further comprising a spout adapter mounted with respect to the first end portion of the structural conduit, the spout adapter including a pressure activated control valve adapted to permit flow of liquid into the spout assembly from a nozzle at a predetermined liquid pressure.

21. The spout assembly of claim 20, wherein the spout adapter further includes at least one internal adapter sidewall including a first adapter sidewall portion with a first adapter cross-sectional dimension adapted to receive a portion of the pressure activated control valve, a second adapter sidewall portion with a second adapter cross-sectional dimension that is smaller than the first adapter cross-sectional dimension, and an adapter transition location between the first and second adapter sidewall portions, wherein the adapter transition location provides for the change in cross-sectional dimensions between the first adapter sidewall portion and the second adapter sidewall portion, the first adapter sidewall portion includes a length at least partially defining a substantially straight adapter liquid flow path, wherein the substantially straight adapter liquid flow path extends through the adapter transition location without the adapter transition location changing the substantially straight liquid flow path.

22. The spout assembly of claim 21, further comprising a fluid tube disposed in the interior passage of the structural conduit and in fluid communication with the pressure activated control valve, wherein the second adapter cross-sectional dimension is adapted to receive a first end portion of the fluid tube, and wherein a second end portion of the fluid tube is adapted to dispense liquid adjacent the second end portion of the structural conduit.

23. A spout assembly for dispensing liquid from a nozzle, comprising:

a) a structural conduit including:

i) a first end portion for attaching relative to a nozzle body and a second end portion for dispensing liquid;

ii) an interior passage providing an internal flow path from the first end portion to the second end portion; and iii) at least one internal sidewall, the internal sidewall including a first sidewall portion with a first cross-sectional dimension, a second sidewall portion with a second cross-sectional dimension that is smaller than the first cross-sectional dimension, and a transition location between the first and second sidewall portions, wherein the transition location provides for the change in cross-sectional dimensions between the first sidewall portion and the second sidewall portion, wherein the internal sidewall is adapted to substantially prevent pooling of liquid being dispensed from the nozzle, wherein the first sidewall portion includes a length that at least partially defines a first substantially straight liquid flow path, the second sidewall portion includes a length that at least partially defines a second substantially straight liquid flow path that is oriented at an obtuse interior angle with respect to the first substantially straight liquid flow path, wherein a curved portion of the interior sidewall provides the transition between the substantially straight liquid flow paths of the first and second sidewall portions, wherein a corresponding imaginary tangential line extends through each point along the curved portion, each imaginary tangential line extending at an interior angle with respect to the substantially straight liquid flow path of the first portion in the range from about 180° to about the obtuse internal angle, wherein the interior angle of each tangential line is successively smaller along the curved portion from the first sidewall portion to the second sidewall portion.

24. A spout assembly for dispensing liquid from a nozzle, comprising:

a) a structural conduit including:

i) a first end portion for attaching relative to a nozzle body and a second end portion for dispensing liquid;

ii) an interior passage providing an internal flow path from the first end portion to the second end portion; and iii) at least one internal sidewall, the internal sidewall including a first sidewall portion with a first cross-sectional dimension, a second sidewall portion with a second cross-sectional dimension that is smaller than the first cross-sectional dimension, and a transition location between the first and second sidewall portions, wherein the transition location provides for the change in cross-sectional dimensions between the first sidewall portion and the second sidewall portion, wherein the internal sidewall is adapted to substantially prevent pooling of liquid being dispensed from the nozzle b) a spout adapter mounted with respect to the first end portion of the structural conduit, the spout adapter including a pressure activated control valve adapted to permit flow of liquid into the spout assembly from a nozzle at a predetermined liquid pressure, wherein the spout adapter further comprises a venturi channel and an attitude device in fluid communication with the venturi channel, wherein the attitude device comprises a closing body adapted to close an opening of the venturi channel upon tilting of the spout assembly beyond a predetermined angle.

25. The spout assembly of claim 24, wherein the attitude device further comprises a bridge to trap the closing body in an interior area of the spout adapter.

26. The spout assembly of claim 25, wherein the bridge includes an aperture adapted to facilitate a pressure differential to bias the closing body against the bridge unless the spout assembly is tilted beyond a predetermined angle.

27. The spout assembly of claim 24, wherein the spout adapter further includes at least one adapter internal sidewall including a first adapter sidewall portion with a first adapter cross-sectional dimension adapted to receive a portion of the pressure activated control valve, a second adapter sidewall portion with a second adapter cross-sectional dimension that is smaller than the first adapter cross-sectional dimension, and an adapter transition location between the first and second adapter sidewall portions, wherein the adapter transition location provides for the change in cross-sectional dimensions between the first adapter sidewall portion and the second adapter sidewall portion, the first adapter sidewall portion includes a length at least partially defining a substantially straight adapter liquid flow path, wherein the substantially straight adapter liquid flow path extends through the adapter transition location without the adapter transition location changing the substantially straight liquid flow path.

28. A spout assembly for dispensing liquid from a nozzle and movable between a storage orientation and a dispensing orientation, comprising:

a) a structural conduit including:

i) a first end portion for attaching relative to a nozzle body and a second end portion for dispensing liquid;

ii) an interior passage providing an internal liquid flow path in a general direction from the first end portion to the second end portion; and iii) at least one internal sidewall defining the internal flow path running from the first end portion to the second end portion, each of the first end portion and the second end portion having generally cylindrical configurations with a diameter of the internal flow path in the second end being reduced relative to the diameter of the internal flow path in the first end; and b) a transition portion positioned intermediate the first end portion and the second end portion for reducing the cross-sectional area of the internal flow path therebetween, the internal liquid flow path in the transition portion being asymmetrically tapered to alter the cross-sectional area of the internal liquid flow path from a first inside diameter of the liquid flow path adjacent an inlet end of the transition portion to a second inside diameter of the liquid flow path adjacent an outlet end of the transition portion, a lower inside surface of the liquid flow path in the transition portion being flattened relative to an opposed upper inside surface of the transition portion so that, when the spout is in a dispensing orientation, the lowest point in any cross-sectional portion of the flow path through the transition portion is not at a substantially higher elevation than a line connecting the lowest points of the flow path at the respective upstream portions of the first end portion and the transition portion.

29. The spout assembly of claim 28, wherein the spout assembly further comprises a pressure activated liquid control valve that is positioned upstream of the transition portion.

* * * * *

UNITED STATES PATENT AND TRADEMARK OFFICE

CERTIFICATE OF CORRECTION

PATENT NO. : 7,134,580 B2
APPLICATION NO. : 10/684331
DATED : November 14, 2006
INVENTOR(S) : Timothy M. Garrison et al.

It is certified that error appears in the above-identified patent and that said Letters Patent is hereby corrected as shown below:

Claim 1, column 28, line 17 - change “First” to --first--.

Claim 19, column 30, line 58 - change “1800” to --180°--.

Signed and Sealed this

Thirteenth Day of February, 2007

JON W. DUDAS
*Director of the United States Patent and Trademark Office*